US010800560B2

(12) United States Patent
Hayami et al.

(10) Patent No.: US 10,800,560 B2
(45) Date of Patent: Oct. 13, 2020

(54) PACKAGING KIT, PACKAGE, PACKAGING METHOD USING PACKAGING KIT, PACKAGING KIT MANUFACTURING APPARATUS, AND PACKAGING KIT MANUFACTURING METHOD

(71) Applicants: TAIYO SHIGYO CO., LTD., Hyogo (JP); NISSANKIKO CO., LTD., Kyoto (JP); TOMOKU CO., LTD., Tokyo (JP)

(72) Inventors: Shinji Hayami, Uji (JP); Masaaki Kanemaru, Tokyo (JP)

(73) Assignees: TAIYO SHIGYO CO., LTD., Hyogo (JP); NISSANKIKO CO., LTD., Kyoto (JP); TOMOKU CO., LTD, Tokyo (JP)

( * ) Notice: Subject to any disclaimer, the term of this patent is extended or adjusted under 35 U.S.C. 154(b) by 255 days.

(21) Appl. No.: 15/750,135

(22) PCT Filed: Aug. 4, 2016

(86) PCT No.: PCT/JP2016/072969
§ 371 (c)(1),
(2) Date: Feb. 2, 2018

(87) PCT Pub. No.: WO2017/022832
PCT Pub. Date: Feb. 9, 2017

(65) Prior Publication Data

US 2018/0229868 A1 Aug. 16, 2018

(30) Foreign Application Priority Data

Aug. 4, 2015 (WO) ..... PCT/JP2015/072082

(51) Int. Cl.
*B65B 11/06* (2006.01)
*B65D 5/50* (2006.01)
(Continued)

(52) U.S. Cl.
CPC ..... *B65B 11/06* (2013.01); *B31B 50/64* (2017.08); *B31D 1/0043* (2013.01);
(Continued)

(58) Field of Classification Search
CPC ..... B65D 5/02; B65D 5/5028; B65D 5/5085; B65D 5/48034; B65D 5/18; B65D 5/0018;
(Continued)

(56) References Cited

U.S. PATENT DOCUMENTS 2,907,152 A * 10/1959 Hensgen ..... B65B 35/44 53/473
2,939,258 A * 6/1960 Anness ..... B65B 11/105 53/558
(Continued)

FOREIGN PATENT DOCUMENTS

JP H09-501128 A 2/1997
JP 3189377 U 3/2014
(Continued)

OTHER PUBLICATIONS

International Search Report issued in PCT/JP2016/072969; dated Oct. 25, 2016.
(Continued)

*Primary Examiner* — Robert F Long
*Assistant Examiner* — Eduardo R Ferrero
(74) *Attorney, Agent, or Firm* — Studebaker & Brackett PC

(57) ABSTRACT

A packaging kit manufacturing apparatus (600) manufactures a packaging kit (501). The packaging kit manufacturing apparatus (600) includes: a film feeding section (610) that feeds a film (31, 32); a conveyance section (620) that conveys a plate-shaped member (510) such that a leading end of the plate-shaped member (510) pushes the film (31,
(Continued)

32); a welding section (640) that welds the film (31, 32) to form a tubular film (530); a retracting section (650) that retracts the film (32) to fold the plate-shaped member (510) along a fold line (21) before the welding section (640) welds the film (31, 32); and a lift restricting section (660) that restricts lift of the leading end of the plate-shaped member (510) when the film (32) is retracted by the retracting section (650).

19 Claims, 30 Drawing Sheets

(51) Int. Cl.

| | |
|---|---|
| ***B31B 50/64*** | (2017.01) |
| ***B65D 73/00*** | (2006.01) |
| ***B31D 1/00*** | (2017.01) |
| *B65B 5/02* | (2006.01) |
| *B65B 41/12* | (2006.01) |
| *B65B 41/02* | (2006.01) |

(52) U.S. Cl.
CPC ..... *B65D 5/5028* (2013.01); *B65D 73/00* (2013.01); *B65B 5/02* (2013.01); *B65B 41/02* (2013.01); *B65B 41/12* (2013.01)

(58) Field of Classification Search
CPC ..... B65D 5/0095; B65D 73/00; B65D 77/02; B65D 77/042; B65D 77/20; B65D 81/07; B65D 81/05; B65D 81/02; B65D 81/3848; B65D 75/006; B65B 25/0065; B65B 41/02; B65B 41/12; B65B 11/10; B65B 11/08; B65B 11/06; B65B 23/00; B65B 41/00; B65B 5/02; B31D 1/0043; B31B 50/65; B31B 50/64
USPC ..... 53/397, 399, 441, 456, 466, 410, 556, 53/558, 580, 228; 206/583, 594, 591
See application file for complete search history.

(56) References Cited

U.S. PATENT DOCUMENTS 3,002,432 A * 10/1961 Wendshuh ..... B65B 25/065 493/263
3,375,152 A * 3/1968 Lundberg ..... B29C 63/044 156/212
3,600,872 A * 8/1971 Sharpnack ..... B65B 5/10 53/397
3,742,676 A * 7/1973 Lawing ..... B65B 25/20 53/429
3,803,332 A * 4/1974 Seiferth et al. ..... B65D 25/54 426/121
3,815,319 A * 6/1974 Vedvik ..... B26D 7/32 53/397
3,965,645 A * 6/1976 Ganz ..... B65B 11/004 53/398
3,978,260 A * 8/1976 Dobbins ..... B32B 27/32 428/204
4,003,184 A * 1/1977 Shiu ..... B65B 25/065 53/461
4,085,564 A * 4/1978 Focke ..... B65B 11/50 53/207
4,125,633 A * 11/1978 Vander Lugt, Jr. ..... B65D 5/2023 229/112
4,216,579 A * 8/1980 Murata ..... B65B 11/08 29/623.2
4,288,968 A * 9/1981 Seko ..... B29C 65/18 156/583.1
4,328,657 A * 5/1982 Brandmaier ..... B65B 25/065 271/102
4,342,182 A * 8/1982 Dennis ..... B65B 25/065 493/407
4,371,553 A * 2/1983 Gilling ..... B65D 75/38 229/87.11
4,375,482 A * 3/1983 Maroszek ..... B65D 75/54 229/87.11
4,453,628 A * 6/1984 Walter ..... B65D 77/26 206/778
4,509,314 A * 4/1985 Bozza ..... B65B 11/10 53/228
4,549,386 A * 10/1985 Wilson ..... B29C 66/96 53/374.4
4,552,789 A * 11/1985 Winchell ..... B32B 27/32 428/132
4,894,248 A * 1/1990 Pappas ..... B65D 77/003 426/121
4,920,731 A * 5/1990 Rimondi ..... B65B 11/10 53/229
5,087,498 A * 2/1992 Nedblake ..... B32B 1/04 428/76
5,323,896 A 6/1994 Jones
5,326,577 A * 7/1994 Warnock ..... B65D 71/10 426/124
5,676,245 A * 10/1997 Jones ..... B65D 5/5028 206/223
5,694,744 A * 12/1997 Jones ..... B65D 5/5028 206/223
5,845,464 A * 12/1998 Draghetti ..... B65B 11/10 53/466
5,934,473 A * 8/1999 Belshe ..... B65B 61/20 206/320
RE36,412 E 11/1999 Jones
6,047,831 A * 4/2000 Jones ..... B65D 5/5028 206/466
6,074,678 A * 6/2000 Blackwelder ..... B32B 5/18 426/129
6,311,843 B1 11/2001 Smith et al.
7,753,209 B2 * 7/2010 McDonald ..... B65D 81/07 206/583
7,918,339 B2 4/2011 Kashiwabara
8,871,286 B2 * 10/2014 Fritz ..... B65D 81/203 206/459.5
2002/0059785 A1 * 5/2002 Gamberini ..... B65B 11/10 53/543
2002/0073649 A1 * 6/2002 Gamberini ..... B65B 11/10 53/228
2002/0073655 A1 * 6/2002 Gamberini ..... B65B 11/10 53/438
2002/0194820 A1 * 12/2002 Jones ..... B65B 11/10 53/441
2005/0178095 A1 * 8/2005 Rimondi ..... B29C 65/10 53/550
2007/0272788 A1 * 11/2007 De Matteis ..... B65B 11/10 242/521
2008/0110794 A1 * 5/2008 Anderson ..... B65B 53/02 206/583
2010/0000907 A1 1/2010 Kashiwabara
2010/0139218 A1 * 6/2010 Jorgensen ..... B65B 11/10 53/461
2011/0108448 A1 * 5/2011 Goodrich ..... B65B 5/04 206/461
2012/0192526 A1 * 8/2012 Spix ..... B65B 57/14 53/396
2012/0291399 A1 * 11/2012 Bonneville ..... B65B 9/04 53/203
2013/0152512 A1 * 6/2013 Sdahl ..... B65B 11/06 53/461
2013/0318914 A1 * 12/2013 Takata ..... B65B 31/06 53/203
2014/0061085 A1 * 3/2014 LeRoy ..... B65D 75/305 206/484
2015/0266642 A1 * 9/2015 McDonald ..... B65D 5/5028 206/484
2016/0176551 A1 * 6/2016 Matsumoto ..... B29C 65/02 53/329.2

(56) References Cited

U.S. PATENT DOCUMENTS

| | | | | |
|---|---|---|---|---|
| 2017/0190449 | A1* | 7/2017 | King | B65B 25/065 |
| 2017/0247163 | A1* | 8/2017 | Ridgeway | B65D 81/05 |
| 2017/0320606 | A1* | 11/2017 | Kuhmichel | B65B 25/068 |

FOREIGN PATENT DOCUMENTS

| | | | |
|---|---|---|---|
| JP | 2014-218305 | A | 11/2014 |
| JP | 2015-127208 | A | 7/2015 |
| WO | 95/00410 | A1 | 1/1995 |
| WO | 2008/126199 | A1 | 10/2008 |

OTHER PUBLICATIONS

An Office Action mailed by the Korean Intellectual Property Office dated May 16, 2019, which corresponds to Korean Patent Application No. 10-2017-7035988 and is related to U.S. Appl. No. 15/750,135.

* cited by examiner

PACKAGING KIT, PACKAGE, PACKAGING METHOD USING PACKAGING KIT, PACKAGING KIT MANUFACTURING APPARATUS, AND PACKAGING KIT MANUFACTURING METHOD

TECHNICAL FIELD

The present invention relates to a packaging kit, a package, a packaging method using a packaging kit, a packaging kit manufacturing apparatus, and a packaging kit manufacturing method, and particularly relates to a packaging kit capable of holding an article in position, a package, a packaging method using a packaging kit, a packaging kit manufacturing apparatus, and a packaging kit manufacturing method.

BACKGROUND ART

As a packaging kit used for packaging an article, there has been used a packaging kit that holds an article in position by interposing the article between a film and a plate-shaped member and tightening the film to press the article against the plate-shaped member.

A heat-shrinkable film is typically used in such a packaging kit. The film shrinks by heat when it is passed through a shrink tunnel. Thus, the film is tightened and the article is secured against the plate-shaped member.

Patent Literature 1 discloses a structure for pressing an article against a plate-shaped member by using a flexible sheet fixed to the plate-shaped member and folding a part of the plate-shaped member to which the sheet is fixed toward the lower surface of the plate-shaped member.

CITATION LIST

Patent Literature

Patent Literature 1
Japanese Utility Model Registration No. 3189377

SUMMARY OF INVENTION

Technical Problem

A method for packaging an article through heat shrinkage of a film as described above has the following problems. That is, an apparatus for generating heat to cause heat shrinkage of the film, such as the shrink tunnel is necessary in a packaging process. Therefore, a large amount of energy such as electricity is consumed by the above apparatus or in environment for packaging. Also, it is difficult to introduce a large-sized expensive apparatus as described above in a situation in which packaging is performed occasionally rather than successively to package a large number of articles.

In contrast, for example, a packaging material having a structure as disclosed in Patent Literature 1 can eliminate the need for an apparatus such as the shrink tunnel for performing packaging. However, in such a structure, it is necessary to fix the flexible sheet to the plate-shaped member. Therefore, the structure of the packaging material is complicated, resulting in a problem of a high manufacturing cost. Also, it is necessary for securing an article to fold the part of the plate-shaped member, to which the sheet is fixed, toward the lower surface of the plate-shaped member, resulting in a problem of an addition of a process.

The present invention was made to solve the above problems, and it is an object of the present invention to provide a packaging kit capable of packaging an article easily with a simple structure, a package, a packaging method using a packaging kit, a packaging kit manufacturing apparatus, and a packaging kit manufacturing method.

Solution to Problem

According to an aspect of the present invention to achieve the above object, a packaging kit manufacturing apparatus that manufactures a packaging kit including a plate-shaped member having an upper surface with a fold line thereon and a tubular film lapped around the plate-shaped member includes: a film feeding section that feeds a film; a conveyance section that conveys a plate-shaped member having an upper surface with a fold line thereon such that a leading end of the plate-shaped member pushes the film; a welding section that welds the film to form the tubular film; a retracting section that retracts the film to fold the plate-shaped member along the fold line before the welding section welds the film; and a lift restricting section that restricts lift of the leading end of the plate-shaped member when the film is retracted by the retracting section.

Preferably, the lift restricting section includes: a contact portion that comes into contact with the plate-shaped member when the film is retracted by the retracting section; and a holding portion that holds the contact portion. The holding portion is capable of changing a position to hold the contact portion.

Preferably, when the film is retracted by the retracting section, the lift restricting section comes into contact with a part of the upper surface of the plate-shaped member that is closer to the leading end of the plate-shaped member than the fold line.

Preferably, when the film is retracted by the retracting section, the lift restricting section comes into contact with a part of the plate-shaped member that is close to the leading end of the plate-shaped member and that does not overlap the film.

Preferably, the conveyance section includes: a placement section on which the plate-shaped member is placed; a pushing section that pushes a trailing end of the plate-shaped member placed on the placement section to convey the plate-shaped member in a horizontal direction; and a guide section that guides the plate-shaped member while restricting lift of the plate-shaped member such that the leading end of the plate-shaped member passes under the lift restricting section.

Preferably, the guide section is arranged at a position not interfering with the lift restricting section when the conveyance section completes conveyance of the plate-shaped member.

Preferably, the packaging kit manufacturing apparatus further includes a pressing section that presses the plate-shaped member while being out of contact with the film after the conveyance section completes conveyance of the plate-shaped member.

Preferably, the welding section includes: a sealing section including a heat source; and a sealing section receiving section that receives the sealing section. The welding section welds the film by bringing the sealing section and the sealing section receiving section into contact with each other. When the film is retracted by the retracting section, a gap between the sealing section and the sealing section receiving section is larger than a thickness of the film and smaller than a thickness of the plate-shaped member.

According to yet another aspect of the present invention, a packaging kit manufacturing method for manufacturing a packaging kit including a plate-shaped member having an upper surface with a fold line thereon and a tubular film lapped around the plate-shaped member includes: preparing a film, a plate-shaped member having an upper surface with a fold line thereon, and a packaging kit manufacturing apparatus including a lift restricting section and a welding section; lapping the film around the plate-shaped member in a manner that the film comes into contact with the plate-shaped member from a leading end to a trailing end thereof by pushing the film with the leading end of the plate-shaped member; retracting the film to fold the plate-shaped member along the fold line until lift of the leading end of the plate-shaped member is restricted by the lift restricting section; and forming the tubular film by welding the film by the welding section.

Preferably, in the retracting, the leading end of the plate-shaped member comes into contact with the lift restricting section.

Preferably, in the lapping, the leading end of the plate-shaped member passes under the lift restricting section.

Preferably, the packaging kit manufacturing apparatus further includes a conveyance section that conveys the plate-shaped member such that the leading end of the plate-shaped member pushes the film. In the lapping, the conveyance section conveys the plate-shaped member while restricting lift of the plate-shaped member such that the leading end of the plate-shaped member passes under the lift restricting section.

Preferably, the packaging kit manufacturing apparatus further includes a pressing section that presses the plate-shaped member while out of contact with the film. In the lapping, the pressing section presses the plate-shaped member after the conveyance section completes conveyance of the plate-shaped member and before the retracting.

According to another aspect of the present invention, a packaging kit used for packaging an article includes a plate-shaped member and a tubular film lapped around the plate-shaped member. The plate-shaped member is partitioned by a fold line and has a placement surface portion on which the article to be packaged is to be placed and an adjacent surface portion adjacent to the placement surface portion with the fold line therebetween. The tubular film is lapped around the plate-shaped member such that the fold line between the placement surface portion and the adjacent surface portion passes through a tube that the tubular film forms. The article is capable of being placed in a space between the placement surface portion and the tubular film in a state where the adjacent surface portion is folded relative to the placement surface portion. When the tubular film is tightened while being in contact with the article in accompaniment with unfolding of the adjacent surface portion relative to the placement surface portion in a state where the article is placed in the space, the article is pressed against the plate-shaped member. The fold line is displaced from a center of the plate-shaped member.

Preferably, the plate-shaped member is made from a corrugated board and the fold line of the plate-shaped member is formed to traverse waves of a core sheet of the plate-shaped member.

Preferably, the placement surface portion of the plate-shaped member has an area larger than that of the adjacent surface portion.

Preferably, the tubular film is a stretchable film.

Preferably, the plate-shaped member is partitioned by two fold lines including the fold line and an additional fold line that does not intersect with the fold line on the plate-shaped member. The plate-shaped member has a single placement surface portion as the placement surface portion and two adjacent surface portions including the adjacent surface portion and an additional adjacent surface portion. The two adjacent surface portions each are adjacent to the single placement surface portion with a corresponding one of the two fold lines therebetween.

Preferably, the plate-shaped member is partitioned by a sub-fold line that intersects with the fold line between the placement surface portion and the adjacent surface portion on the plate-shaped member. The plate-shaped member has a stand-up portion adjacent to the placement surface portion with the sub-fold line therebetween. By folding the stand-up portion relative to the placement surface portion along the sub-fold line, the adjacent surface portion is unfolded relative to the placement surface portion and the tubular film is kept tightened.

Preferably, the sub-fold line is perforated, and the fold line is not perforated.

Preferably, the plate-shaped member has two stand-up portions including the stand-up portion and an additional stand-up portion. The two stand-up portions are each defined by a corresponding one of two sub-fold lines. The two sub-fold lines include the sub-fold line and an additional sub-fold line that does not intersect with the sub-fold line on the plate-shaped member.

Preferably, the stand-up portion is partitioned by an auxiliary fold line substantially parallel with the sub-fold line, and has portions defined by the auxiliary fold line therebetween. One of the portions is capable of being folded relative to the other of the portions.

According to another aspect of the present invention, in a package including the packaging kit according to any of the above description and an outer casing that accommodates the packaging kit therein, the stand-up portion of the plate-shaped member is kept folded relative to the placement surface portion when the packaging kit is accommodated in the outer casing in a state where the stand-up portion is folded relative to the placement surface portion.

Preferably, in a state where the packaging kit is accommodated in the outer casing, a bottom part of the packaging kit and an upper part of the stand-up portion are held in contact with or close to an inner surface of the outer casing.

According to yet another aspect of the present invention, a packaging kit includes a plate-shaped member and a tubular film lapped around the plate-shaped member. The plate-shaped member is partitioned by a fold line and has a placement surface portion on which an article to be packaged is to be placed and an adjacent surface portion adjacent to the placement surface portion with the fold line therebetween. The tubular film is lapped around the plate-shaped member such that the fold line between the placement surface portion and the adjacent surface portion passes through a tube that the tubular film forms. The fold line is displaced from a center of the plate-shaped member. A packaging method using the packaging kit includes: folding the adjacent surface portion relative to the placement surface portion; placing the article in a space between the placement surface portion and the tubular film in a state where the plate-shaped member is folded by the folding; and unfolding the adjacent surface portion relative to the placement surface portion in a state where the article is placed in the space by the placing to tighten the tubular film in contact with the article such that the article is pressed against the plate-shaped member.

Preferably, the plate-shaped member is partitioned by a sub-fold line that intersects with the fold line between the placement surface portion and the adjacent surface portion on the plate-shaped member. The plate-shaped member has a stand-up portion adjacent to the placement surface portion with the sub-fold line therebetween. In the unfolding, the adjacent surface portion is unfolded relative to the placement surface portion by folding the stand-up portion relative to the placement surface portion to tighten the tubular film.

Advantageous Effects of Invention

According to the present invention as described above, the article can be placed in the space between the placement surface portion and the film in the state where the plate-shaped member is folded, and the article is pressed against the plate-shaped member by unfolding the adjacent surface portion relative to the placement surface portion to tighten the film. Thus, there are provided a packaging kit capable of packaging an article easily with a simple structure, a package, a packaging method using a packaging kit, a packaging kit manufacturing apparatus, and a packaging kit manufacturing method.

DESCRIPTION OF EMBODIMENTS

The following describes a packaging kit according to embodiments of the present invention.

The packaging kit is formed from a combination of a film in the form of a tube (tubular film) and a plate-shaped member for example made from a corrugated board. In the present description, a tubular film may be simply referred to as a film. The packaging kit is capable of holding an article in position by pressing the article against the plate-shaped member by the film. The article can be placed in a space between the film and a base surface of the plate-shaped member in a state where the plate-shape member is folded. By unfolding the plate-shaped member, the film is tightened and the article is secured by the film.

The packaging kit has a simple structure in which the tubular film is attached to the plate-shaped member. The packaging kit is easy to manufacture. The packaging kit can also be manufactured by lapping a film around the plate-shaped member and joining ends of the film together.

Manual packaging can be easily performed using the packaging kit. The packaging kit can also be used in packaging a large number of articles successively for example in a packaging line. Through use of the packaging kit, packaging can be easily performed in the packaging line.

First Embodiment

Figure 1A:
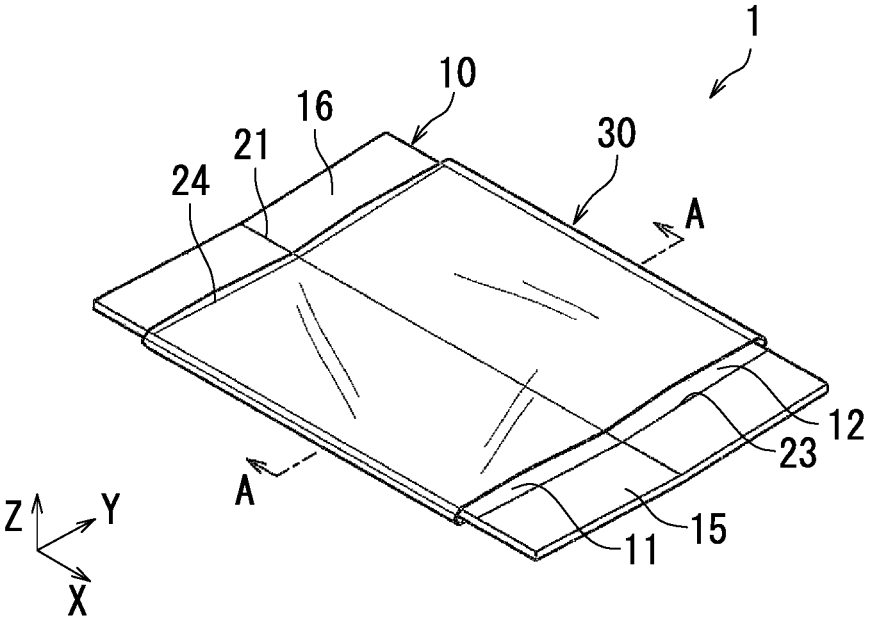
FIG. 1A is a perspective view illustrating a packaging kit according to a first embodiment of the present invention.
Figure 1B:
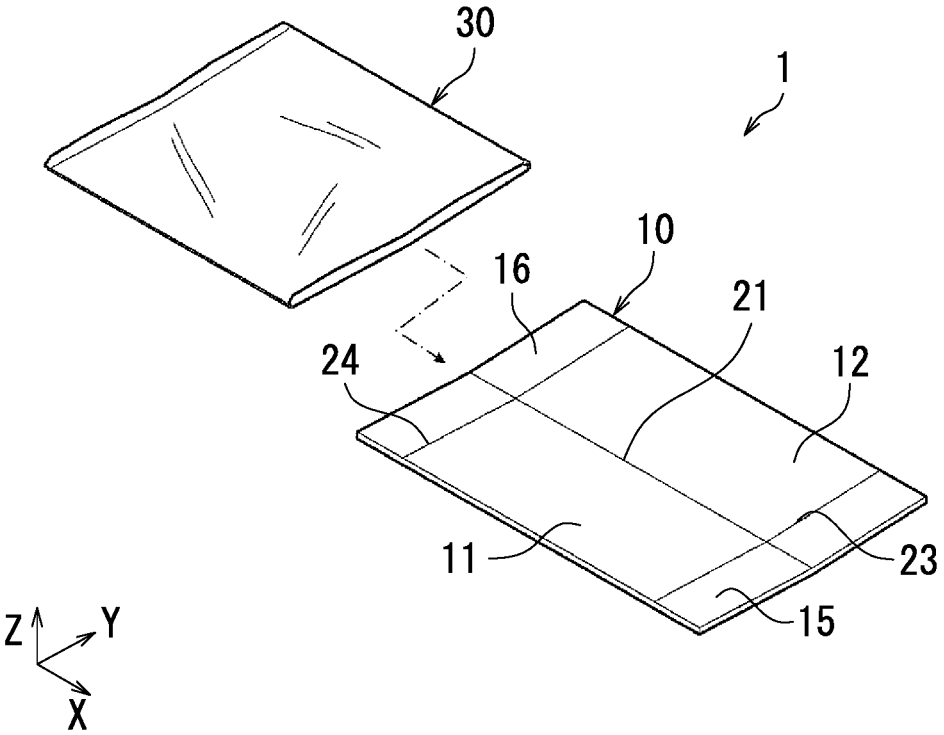
FIG. 1B is an exploded perspective view of the packaging kit according to the first embodiment.
Figure 2:
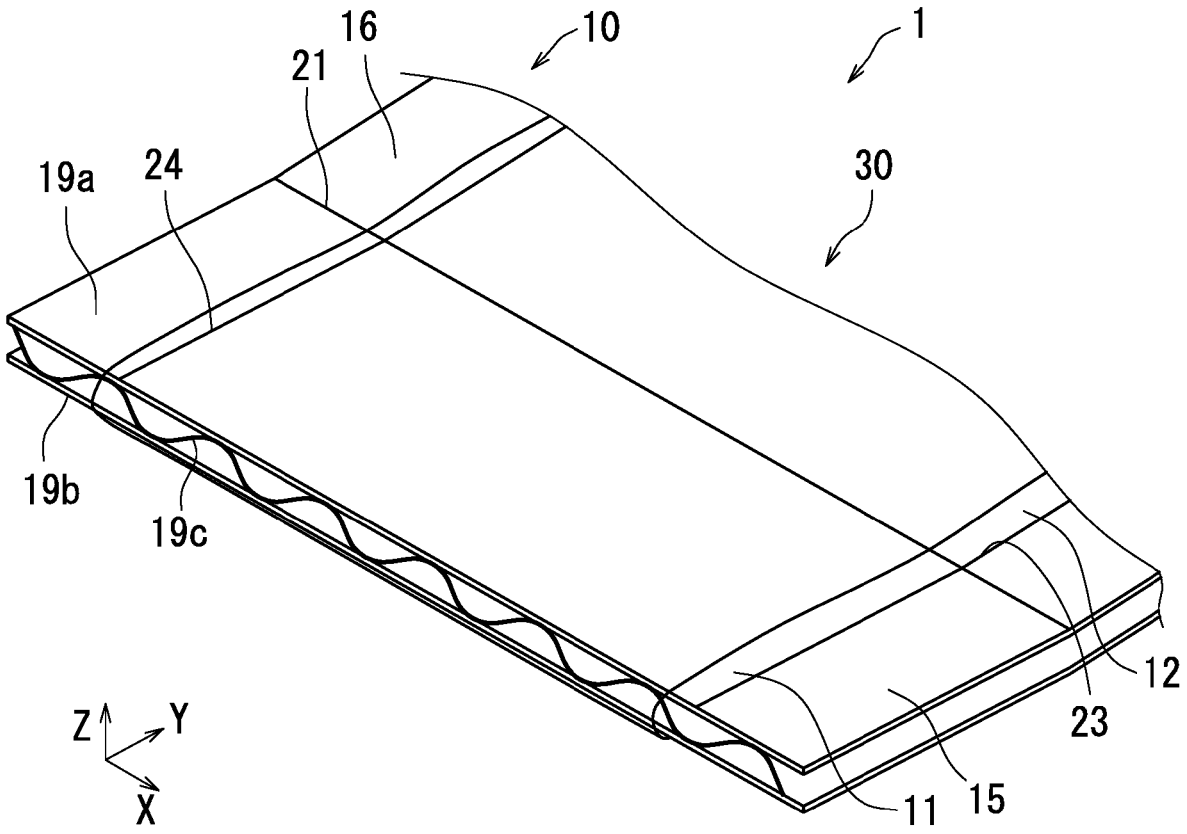
FIG. 2 is an enlarged perspective view of the packaging kit according to the first embodiment.

FIG. 1A is a perspective view illustrating a packaging kit according to a first embodiment of the present invention. FIG. 1B is an exploded perspective view of the packaging kit according to the first embodiment. FIG. 2 is an enlarged perspective view of the packaging kit according to the first embodiment.

In the following description, the X axis direction indicated in FIG. 1A may be referred to as a left-right direction (a direction of positive coordinates on the X axis as seen from the origin is a rightward direction). The Y axis direction indicated in FIG. 1A may be referred to as a front-rear direction (a direction of positive coordinates on the Y axis as seen from the origin is a rearward direction). The Z axis direction indicated in FIG. 1A (a direction perpendicular to an XY plane) may be referred to as an up-down direction (a direction of positive coordinates on the Z axis as seen from the origin is an upward direction).

As illustrated in FIG. 1A, a packaging kit 1 includes a plate (an example of a plate-shaped member) 10 and a tubular film 30. The film 30 is lapped around the plate 10.

The plate 10 in the present embodiment is a single corrugated board for example having a thickness of about 5 mm. The film 30 is a stretchable (flexible) film for example made from polyethylene. The film 30 is, but is not limited to, colorless and transparent. The film 30 may be translucent or opaque, or may be colored.

FIG. 1A illustrates the packaging kit 1 in an unfolded state. Dimensions of the packaging kit 1 in the unfolded state is for example about 300 mm in the left-right direction and about 180 mm in the front-rear direction. Dimensions of the packaging kit 1 are not limited to the above, and are determined according to for example size of an article assumed to be packaged or various intended uses.

As illustrated in FIG. 1B, three fold lines (folds; creases) 21, 23, and 24 are formed on the plate 10. That is, a main fold line 21 and two sub-fold lines 23 and 24 are formed. These fold lines 21, 23, and 24 are formed for example by pressing a so-called creasing roller or a creasing blade against the plate 10. The fold lines 21, 23, and 24 may be perforated.

The main fold line 21 is located at substantially the center of the plate 10 in the front-rear direction in parallel with the left-right direction (parallel with the X axis). The plate 10 can be easily folded along the main fold line 21 in a manner that respective opposite ends of the plate 10 in the front-rear direction are moved upwards.

The sub-fold line 23 is located near the right end of the plate 10 in parallel with the front-rear direction (parallel with the Y axis). The sub-fold line 24 is located near the left end of the plate 10 in parallel with the front-rear direction. The plate 10 can be easily folded along the sub-fold line 23 in a manner that the right end of the plate 10 is moved upwards. The plate 10 can be easily folded along the sub-fold line 24 in a manner that the left end of the plate 10 is moved upwards.

As illustrated in FIG. 2, the plate 10 in the present embodiment is constituted by a front liner 19*a*, a back liner 19*b*, and a core sheet 19*c*. The front liner 19*a* and the back liner 19*b* are plate-shaped. The core sheet 19*c* is corrugated. The sub-fold lines 23 and 24 are formed in parallel with a direction of creases of waves of the core sheet 19*c* of the plate 10 (i.e., a so-called paper width direction). The main fold line 21 is formed to be orthogonal to the direction of the creases of the core sheet 19*c*. That is, the main fold line 21 is formed in parallel with a so-called machine direction. Accordingly, the main fold line 21 is formed to traverse the waves of the core sheet 19*c*. Therefore, when the plate 10 is folded along the main fold line 21, the plate 10 exhibits relatively large resilience to return to the unfolded state.

The plate 10 is partitioned as described below by the main fold line 21 and the sub-fold lines 23 and 24 formed on plate 10.

Figure 3:
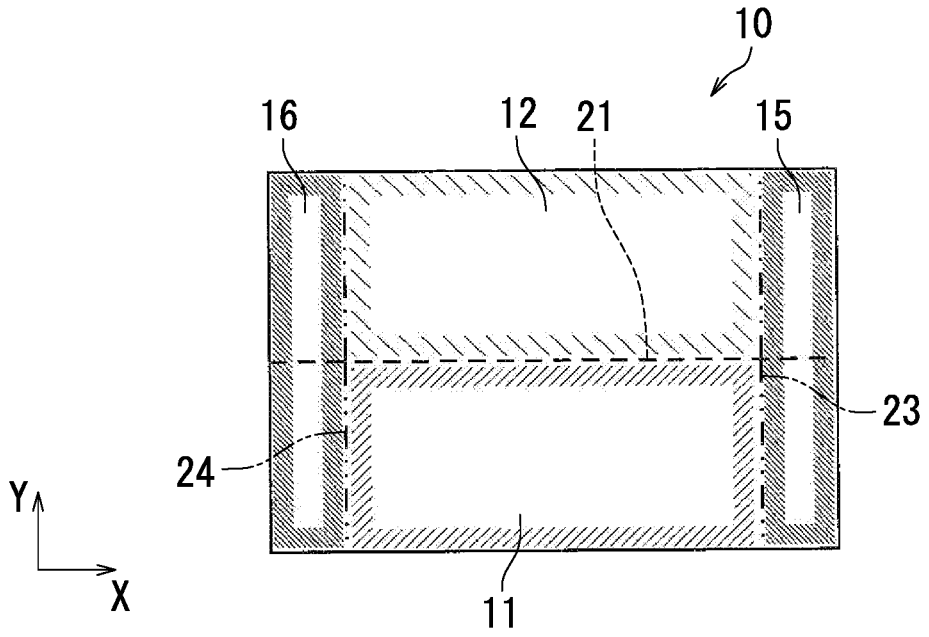
FIG. 3 is a plan view schematically illustrating a plate.

FIG. 3 is a plan view schematically illustrating the plate 10.

Parts surrounded by various types of hatching in FIG. 3 each correspond to a portion described below. As illustrated in FIG. 3, the plate 10 has four portions, that is, a placement surface portion 11 on which an article 50 to be packaged is to be placed, an adjacent surface portion 12 adjacent to the placement surface portion 11, and two stand-up portions 15 and 16.

The main fold line 21 is located between the placement surface portion 11 and the adjacent surface portion 12. In other words, the placement surface portion 11 and the adjacent surface portion 12 are defined by the main fold line 21 located therebetween. The placement surface portion 11 is located in a front part of the plate 10 and the adjacent surface portion 12 is located in a rear part of the plate 10. The stand-up portions 15 and 16 are each adjacent to the placement surface portion 11 and the adjacent surface portion 12, with the sub-fold line 23 located between the stand-up portion 15 and each of the placement surface portion 11 and the adjacent surface portion 12, and the sub-fold line 24 located between the stand-up portion 16 and each of the placement surface portion 11 and the adjacent surface portion 12. The stand-up portion 15 is a part of the plate 10 located to the right of the sub-fold line 23. The stand-up portion 16 is a part of the plate 10 located to the left of the sub-fold line 24. In other words, the placement surface portion 11 is located in front of the main fold line 21 and between the sub-fold lines 23 and 24. The adjacent surface portion 12 is located in rear of the main fold line 21 and between the sub-fold lines 23 and 24.

The plate 10 is configured such that the adjacent surface portion 12 and rear parts of the stand-up portions 15 and 16 can be folded relative to the placement surface portion 11 and front parts of the stand-up portions 15 and 16, respectively, along the main fold line 21.

Referring again to FIG. 1A, the film 30 is placed to surround mainly the placement surface portion 11 and the adjacent surface portion 12 of the plate 10. The tubular film 30 is placed such that its width direction (a direction perpendicular to its circumferential direction) coincides with the left-right direction. In other words, the film 30 is lapped around the plate 10 such that the main fold line 21 passes through a tube that the film 30 forms.

The film 30 may be attached to the plate 10 by various methods. For example, the film 30 may be formed into an annular shape beforehand and attached to the plate 10 by inserting the plate 10 inside the annular film 30. Alternatively, the film 30 may be attached to the plate 10 by lapping the film 30 at least one turn around the plate 10 using for example a band lapping machine and bonding together ends of the film 30. The plate 10 can be folded along the fold lines 21, 23, and 24 in a state where the film 30 is attached to the plate 10.

Next, a method for packaging the article 50 using the packaging kit 1 will be described.

Figure 4:
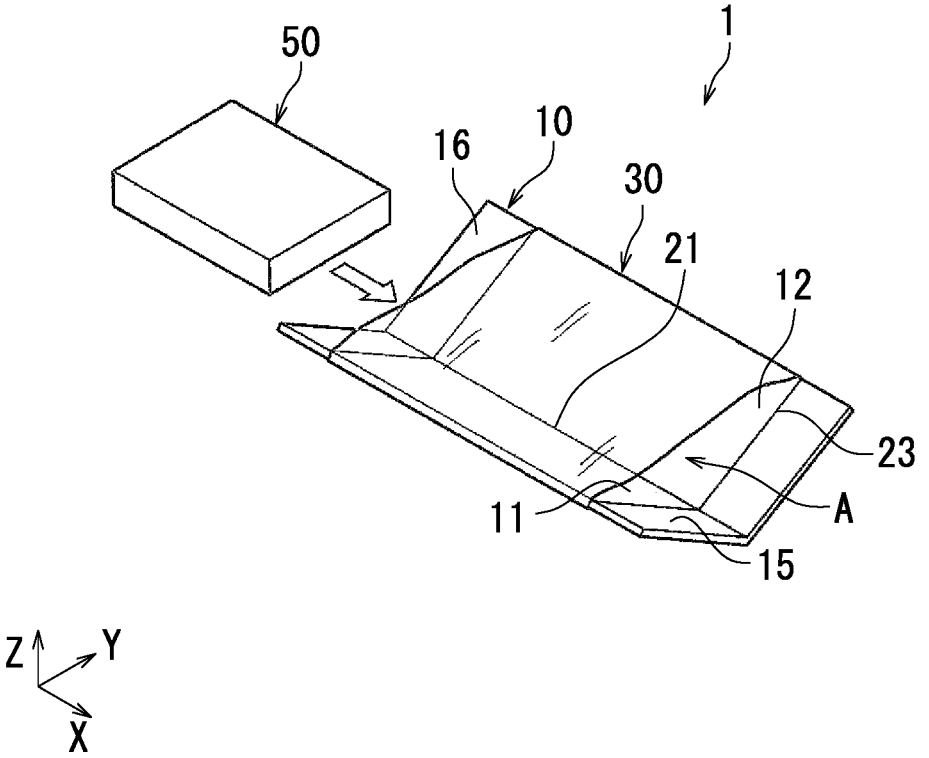
FIG. 4 is a perspective view illustrating the packaging kit in a state where the plate is folded.

FIG. 4 is a perspective view illustrating the packaging kit 1 in a state where the plate 10 is folded.

As illustrated in FIG. 4, the packaging kit 1 is brought into a state (hereinafter may be referred to as a folded state) where the adjacent surface portion 12 is folded relative to the placement surface portion 11 along the main fold line 21. When the packaging kit 1 is in the folded state, the article 50 can be placed in a space A between the film 30 and the upper surface of the plate 10. That is, a course of a straight line that connects the front and rear ends of the plate 10 over the fold on the main fold line 21 when viewed from a side is shorter in the folded state than in the unfolded state. In the folded state, a difference between the length of the above course and the circumferential length of the tubular film 30 becomes large, resulting in formation of the space A among the film 30, the adjacent surface portion 12, and the placement surface portion 11. The article 50 to be packaged can be placed in the above space A.

As a folding angle increases (as an angle between the adjacent surface portion 12 and the placement surface portion 11 decreases), the difference between the length of the above course and the circumferential length of the film 30 increases but a distance between the adjacent surface portion 12 and the placement surface portion 11 decreases. Therefore, the adjacent surface portion 12 is folded relative to the placement surface portion 11 at an angle appropriate to place the article 50 in the space A.

Figure 5:
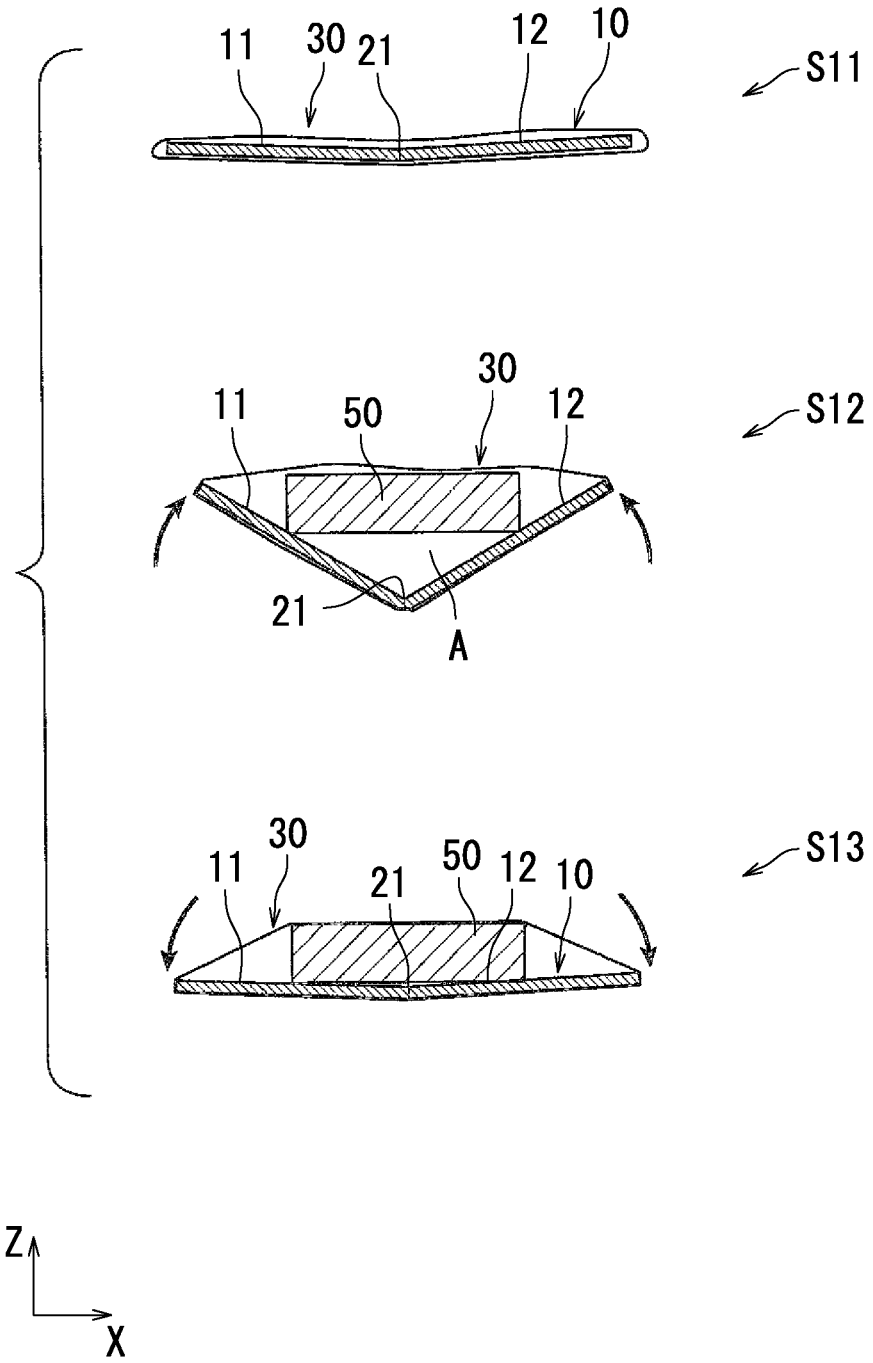
FIG. 5 is a diagram for explaining a packaging method using the packaging kit.

FIG. 5 is a diagram explaining a packaging method using the packaging kit 1.

FIG. 5 illustrates cross sections taken along a line A-A in FIG. 1A. Packaging using the packaging kit 1 is performed through the following steps S11, S12, and S13 in order as illustrated from top to bottom in FIG. 5.

As illustrated in FIG. 5, the packaging kit 1 is flat in the unfolded state (S11). From the unfolded state, the packaging kit 1 is brought into the folded state by folding the plate 10 along the main fold line 21 to make the adjacent surface portion 12 come closer to the placement surface portion 11 as indicated by up arrows in FIG. 5 (folding step).

Then, the article 50 is placed in the space A between the placement surface portion 11 and the film 30 in the state where the plate 10 is folded (S12; placing step).

Thereafter, the packaging kit 1 is brought into the unfolded state by unfolding the adjacent surface portion 12 relative to the placement surface portion 11 as indicated by down arrows in FIG. 5 (S13). Through the above, the film 30 is tightened while in contact with an upper part of the article 50. As a result, the article 50 is pressed against the plate 10 (unfolding step).

Figure 6:
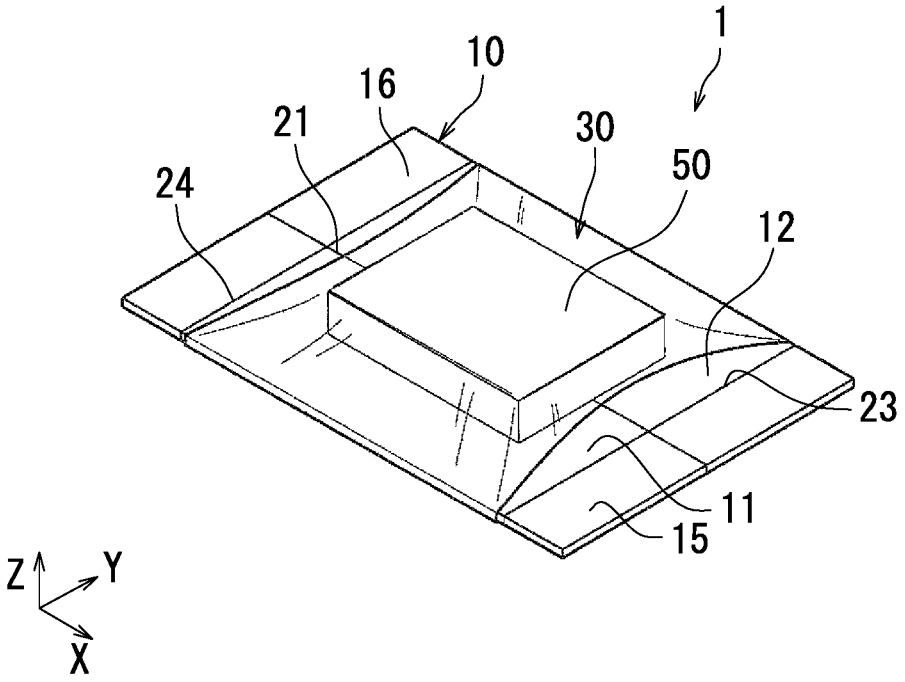
FIG. 6 is a perspective view illustrating the packaging kit in an unfolded state after packaging.

FIG. 6 is a perspective view illustrating the packaging kit 1 in an unfolded state after the packaging.

After the unfolding step, a course of straight lines that connect the front and rear ends of the plate 10 and the upper part of the article 50 over the fold on the main fold line 21 when viewed from a side is longer than in the initial unfolded state since the article 50 is placed as illustrated in FIG. 6. The film 30 in contact with the upper part of the article 50 slightly stretches while being tightened. Therefore, the article 50 is pressed against the plate 10 by the film 30.

In the unfolding step of the present embodiment performed as described above, the stand-up portions 15 and 16 can be folded relative to the placement surface portion 11 along the sub-fold lines 23 and 24, respectively, to stand up. Through the above, the adjacent surface portion 12 can be unfolded relative to the placement surface portion 11 to tighten the film 30. It should be noted that the stand-up portions 15 and 16 may be raised after the unfolding step (raising step).

Figure 7:
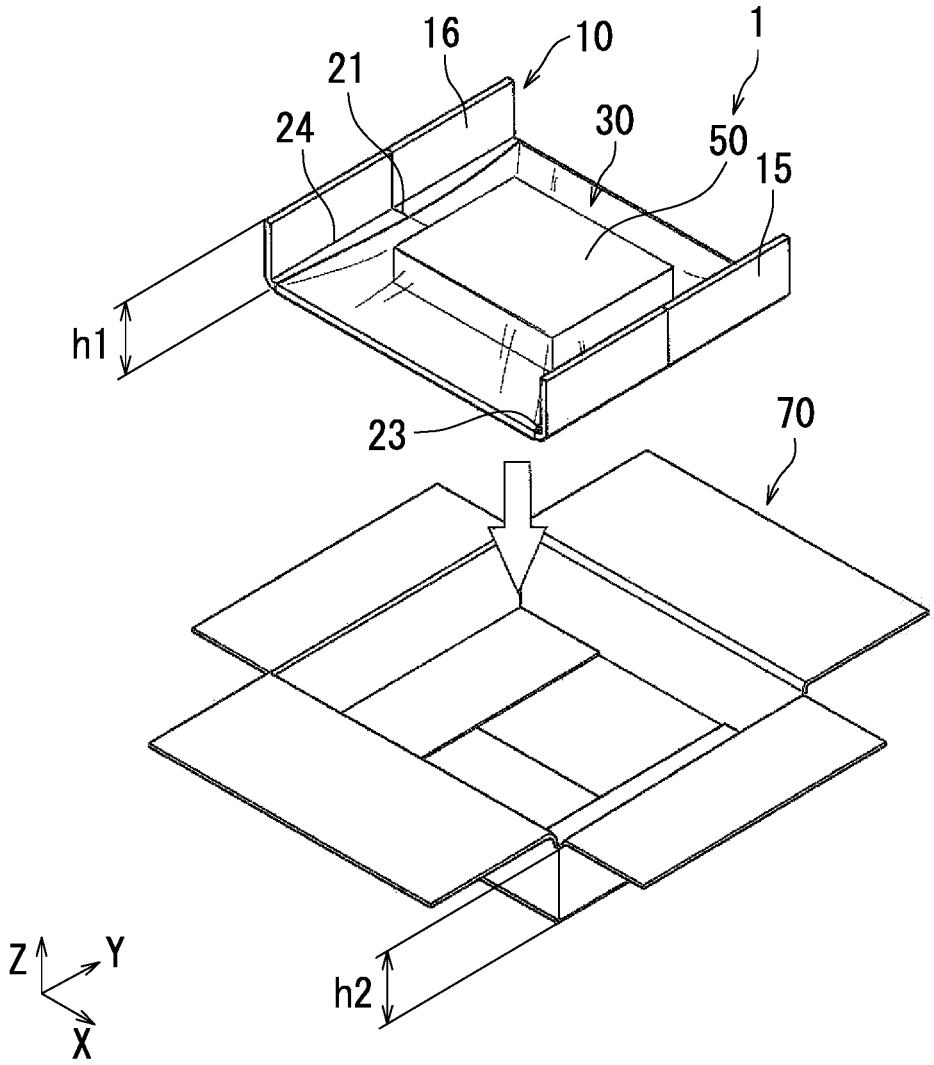
FIG. 7 is a perspective view illustrating a state where stand-up portions are raised.

FIG. 7 is a perspective view illustrating a state where the stand-up portions 15 and 16 are raised.

As illustrated in FIG. 7, the sub-fold lines 23 and 24 intersect with the main fold line 21 on the plate 10. Therefore, when the stand-up portions 15 and 16 are respectively folded along the sub-fold lines 23 and 24, the plate 10 is kept in a state where the placement surface portion 11 and the adjacent surface portion 12 are unfolded relative to each other (a state where the adjacent surface portion 12 is unfolded to be substantially in plane with the placement surface portion 11). In other words, the stand-up portions 15 and 16 cannot be folded unless the placement surface portion 11 and the adjacent surface portion 12 are substantially in plane with each other. In the present embodiment, the two stand-up portions 15 and 16 are defined by the respective two sub-fold lines 23 and 24 that do not intersect with each other on the plate 10. Therefore, by folding the stand-up portions 15 and 16 to stand up, the plate 10 can be surely kept in the state where the placement surface portion 11 and the adjacent surface portion 12 are unfolded relative to each other.

In the present embodiment, the sub-fold lines 23 and 24 are parallel with the direction of the creases of the waves of the core sheet 19*c* of the plate 10. Therefore, the stand-up portions 15 and 16 can be easily kept folded along the sub-fold lines 23 and 24, respectively. As a result, packaging can be easily performed. Alternatively, the sub-fold lines 23 and 24 may be perforated with no perforation along the main fold line 21 so that the stand-up portions 15 and 16 can be easily kept folded along the sub-fold lines 23 and 24, respectively.

Figure 8:
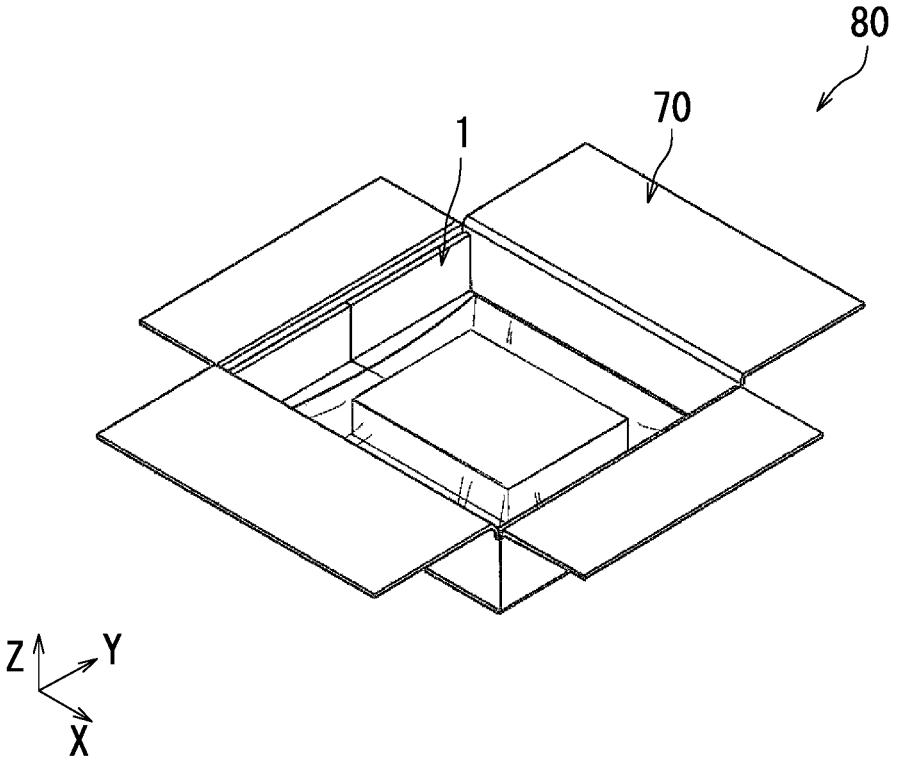
FIG. 8 is a diagram illustrating a package in a state where the packaging kit is accommodated in an outer casing.

FIG. 8 is a diagram illustrating a package 80 in a state where the packaging kit 1 is accommodated in an outer casing 70.

As illustrated in FIG. 8, the packaging kit 1 is accommodated in the outer casing 70 in a state where the stand-up portions 15 and 16 are folded to be substantially perpendicular to the placement surface portion 11. In other words, dimensions of the outer casing 70 are determined such that the packaging kit 1 is fitly accommodated therein in a state where the stand-up portions 15 and 16 are folded as described above. The stand-up portions 15 and 16 are kept folded relative to the placement surface portion 11 when the packaging kit 1 is accommodated in the outer casing 70 in the state where the stand-up portions 15 and 16 are folded relative to the placement surface portion 11. As a result, the film 30 is kept tightened and the article 50 is surely held in position on the plate 10.

The outer casing 70 is a commonly used cardboard box, for example. In the state illustrated in FIG. 8, top flaps of the outer casing 70 are open. When the top flaps of the outer casing 70 are closed, the package 80 is completed in the form of a substantially rectangular parallelepiped.

Figure 9:
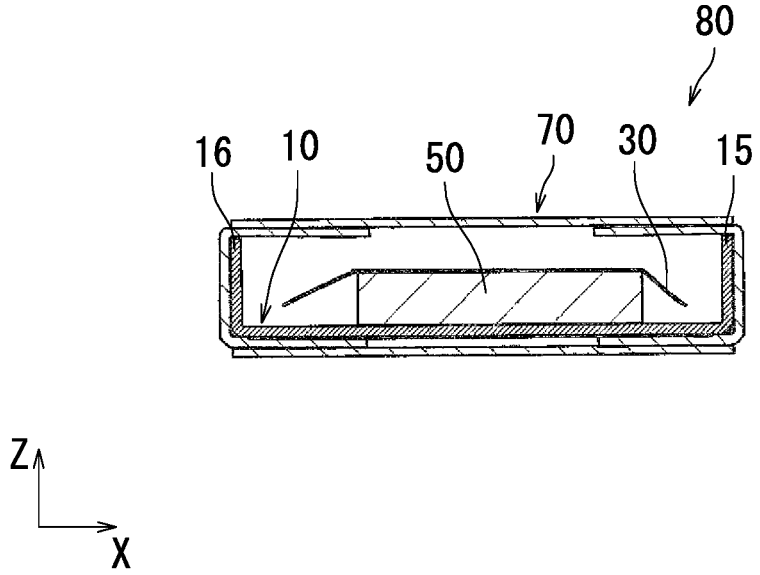
FIG. 9 is a cross-sectional side view illustrating the package.

FIG. 9 is a cross-sectional side view illustrating the package 80.

FIG. 9 illustrates a cross section of the package 80 parallel with the XZ plane in a state where top and bottom flaps of the outer casing 70 are closed. In the present embodiment, when the packaging kit 1 is accommodated in the outer casing 70, a bottom part of the packaging kit 1, that is, the placement surface portion 11 and the adjacent surface portion 12, and upper parts of the stand-up portions 15 and 16 are in contact with inner surfaces of the outer casing 70 as illustrated in FIG. 9. Specifically, the bottom part of the packaging kit 1 is in contact with an inner bottom surface of the outer casing 70 and upper ends of the respective stand-up portions 15 and 16 are in contact with an inner top surface of the outer casing 70. That is, widths of the stand-up portions 15 and 16 from the respective sub-fold lines 23 and 24 (heights in their standing state) indicated by h1 in FIG. 7 are determined to be substantially equal to the height of the outer casing 70 indicated by h2 in FIG. 7.

As a result, the outer casing 70 is kept supported by the stand-up portions 15 and 16 in the up-down direction and the package 80 becomes tough. Further, the packaging kit 1 is held in position within the outer casing 70 without use of an adhesive or the like. Therefore, the article 50 can be firmly secured even when vibration or external force is applied to the package 80 or the package 80 is tilted during transportation. It should be noted that the bottom part of the packaging kit 1 may be held close to the bottom of the outer casing 70 and the upper ends of the stand-up portions 15 and 16 may be held close to the top of the outer casing 70. Similar advantages can also be achieved in the above configuration.

Further, the stand-up portions 15 and 16 are folded upwards and the upper ends of the stand-up portions 15 and 16 are located above the article 50. That is, the article is kept away from the top of the outer casing 70. Therefore, even when a user opens the package 80 using a sharp tool such as a knife to open the top flaps of the outer casing 70, contact between the tool and the article 50 is prevented and the article 50 is protected.

The plate 10 of the packaging kit 1 is preferably a plate-shaped member having a cushioning characteristic such as a corrugated board of a certain thickness. In the above configuration, even when vibration or external force is applied to the package 80, an impact transmitted to the article 50 can be reduced and the article 50 can be more surely protected. Further, the larger the thickness of the plate 10, the larger the resilience of the plate 10 to return from the folded state to a natural state approximate to the unfolded state, and therefore the easier it is to secure the article 50.

As described above, in the first embodiment, the plate 10 of the packaging kit 1 is brought into the folded state to place the article 50 therein and then brought into the unfolded state again, whereby the article 50 can be held in position. Thus, the article 50 can be packaged easily. Once the plate 10 is brought into the folded state, the plate 10 exhibits resilience to return to its natural state approximate to the unfolded state. Therefore, the plate 10 can be easily brought into the unfolded state and no complicated process is necessary to tighten the film 30.

The packaging kit 1 has a simple structure formed from the combination of the plate 10 and the tubular film 30. Therefore, the article 50 can be secured without use of an energy-consuming apparatus or a large-sized apparatus, resulting in reduction in cost necessary for packaging.

In the first embodiment, the packaging kit 1 can be more surely kept holding the article 50 by raising the two stand-up portions 15 and 16.

Unpackaging can be performed by bringing the stand-up portions 15 and 16 into their initial state and bringing the plate 10 from the unfolded state into the folded state as a process reverse to a packaging process. Through the above, the film 30 is loosened and the article 50 can be removed easily. The packaging process includes no irreversible process such as a process that causes heat shrinkage of the film or a process performed using an adhesive. Therefore, packaging and unpackaging can be performed easily as described above. Also, packaging can be performed economically since a packaging kit 1 that has been used for packaging can be reused to package another article 50. An adhesive or the like is not used to combine the film 30 and the plate 10. Therefore, in a situation for example in which only the film 30 is damaged, the packaging kit 1 can be reused by replacing the damaged film 30 by a new film 30.

The packaging kit 1 can be used in both a situation in which packaging is performed manually and a situation in which packaging is performed in a packaging line of a plant or the like to package a large number of articles 50 successively. In a situation in which the packaging kit 1 is used in the packaging line as described above, the packaging kit 1 may be used together with a jig although the packaging kit 1 can also be used alone.

Figure 10:
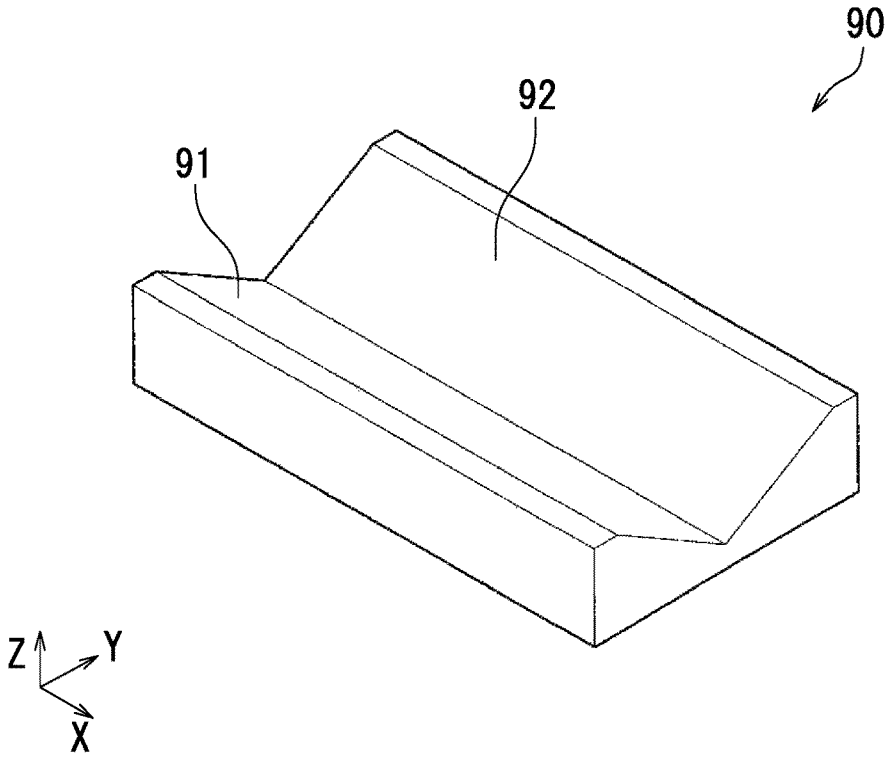
FIG. 10 is a perspective view illustrating an example of a jig used for performing packaging using the packaging kit.

FIG. 10 is a perspective view illustrating an example of a jig 90 used for performing packaging using the packaging kit 1.

As illustrated in FIG. 10, the jig 90 is in the form of a block made from resin, for example. The jig 90 has, as upper surfaces thereof, a support surface 91 and a support surface 92 respectively corresponding to the placement surface portion 11 and the adjacent surface portion 12 of the packaging kit 1. The support surfaces 91 and 92 form a specific angle therebetween. In other words, the jig 90 has a V-shaped groove formed by the support surfaces 91 and 92 in a left-right direction corresponding to the main fold line 21.

Figure 11:
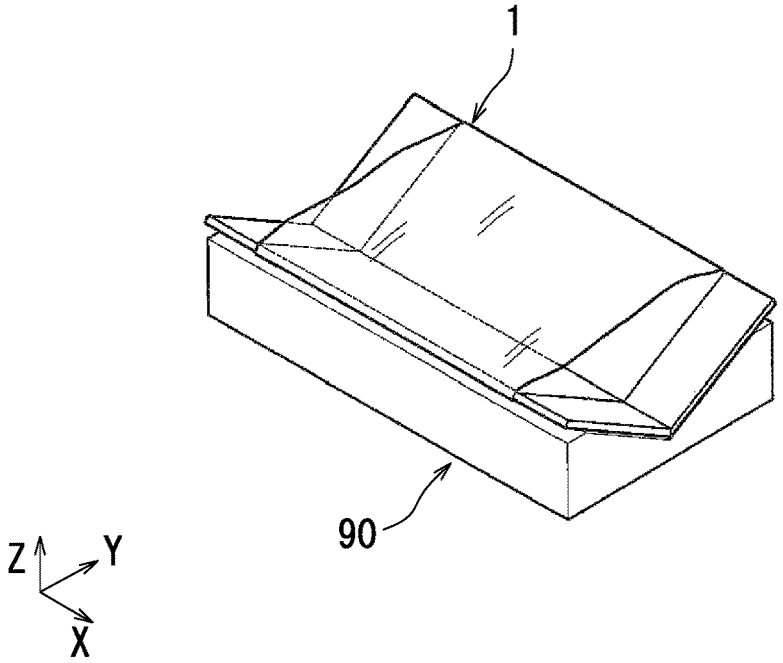
FIG. 11 is a perspective view illustrating an example of use of the jig.

FIG. 11 is a perspective view illustrating an example of use of the jig 90.

As illustrated in FIG. 11, the packaging kit 1 is placed on the upper surfaces of the jig 90. The placement surface portion 11 and the adjacent surface portion 12 of the packaging kit 1 are respectively supported by the support surfaces 91 92 of the jig 90, and the plate 10 is held in the folded state. The article 50 can be placed in the above state.

The jig 90 as described above can be used in a situation in which the packaging kit 1 is used in the packaging line. The jig 90 may be used in a situation in which packaging is performed manually. Although it is difficult to make the packaging kit 1 stand alone in the folded state, packaging can be efficiently performed in a situation in which the plate 10 of the packaging kit 1 is held in the folded state on the plural support surfaces 91 and 92.

Second Embodiment

The basic configuration of a packaging kit according to a second embodiment is the same as that of the packaging kit according to the first embodiment, and description of which will not be repeated. The second embodiment is also the same as the first embodiment in that the two stand-up portions 15 and 16 are provided and a packaged state can be maintained by raising the stand-up portions 15 and 16 in the packaging method. Further, features regarding accommodation of the packaging kit into the outer casing 70 after packaging are also the same between the first and second embodiments. The second embodiment differs from the first embodiment in that two main fold lines are provided in the second embodiment.

Figure 12:
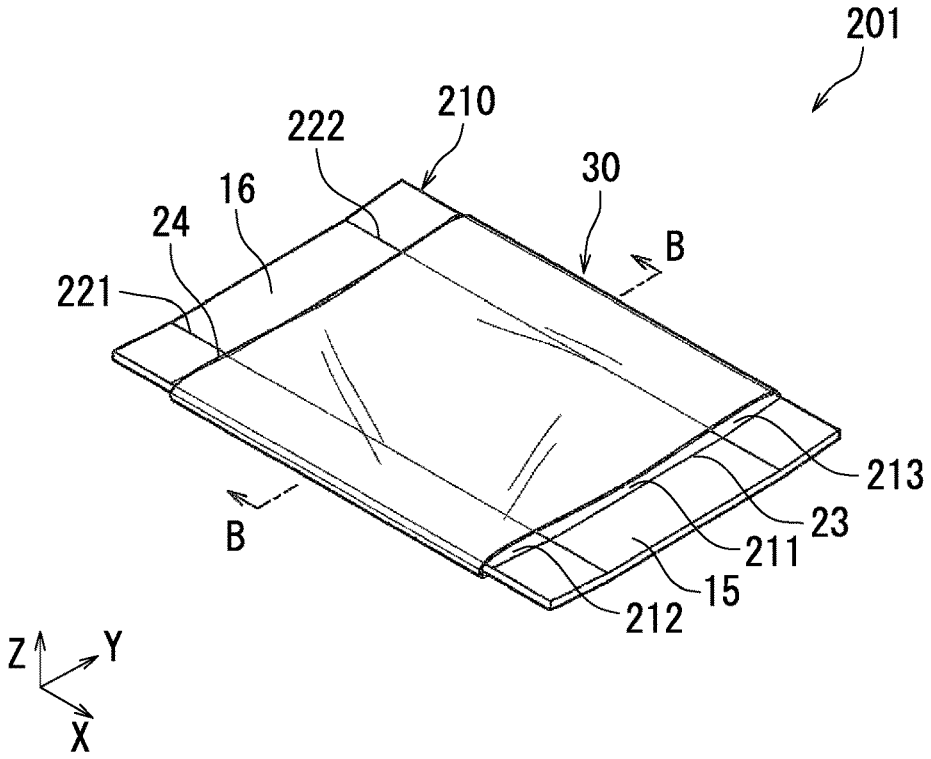
FIG. 12 is a perspective view of a packaging kit according to a second embodiment.
Figure 13:
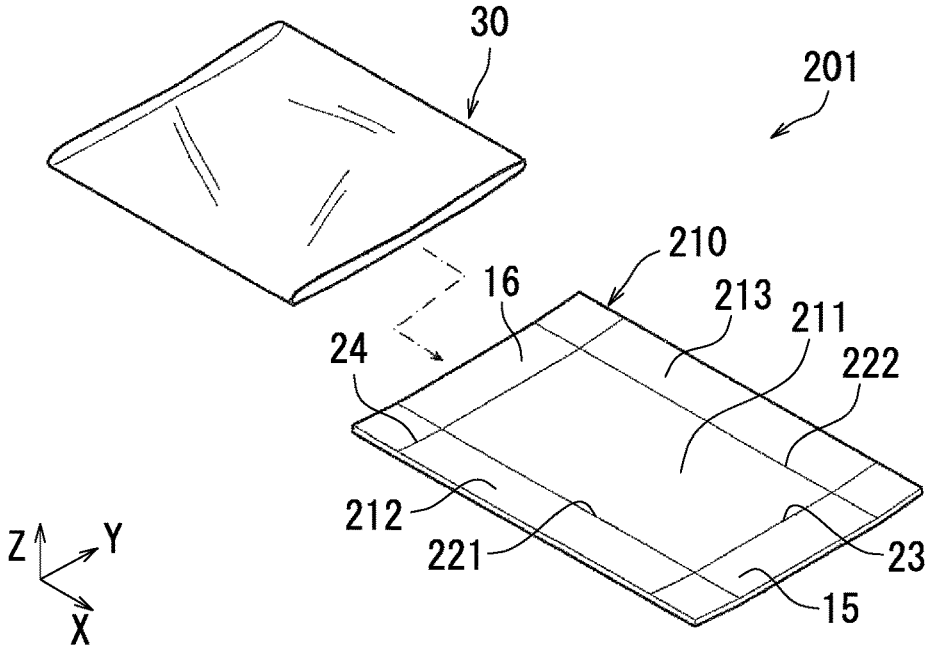
FIG. 13 is an exploded perspective view of the packaging kit according to the second embodiment.

FIG. 12 is a perspective view illustrating a packaging kit 201 according to the second embodiment. FIG. 13 is an exploded perspective view illustrating the packaging kit 201 according to the second embodiment.

As illustrated in FIGS. 12 and 13, the packaging kit 201 is formed from the film 30 and a plate 210 (an example of the plate-shaped member).

The plate 210 differs from the plate 10 in the first embodiment in that the plate 210 has two main fold lines 221 and 222. The plate 210 has the two sub-fold lines 23 and 24 similarly to that in the first embodiment.

The two main fold lines 221 and 222 are arranged so as not to intersect with each other on the plate 210. The main fold lines 221 and 222 in the present embodiment are each parallel with the X axis. The main fold line 221 is close to the front end of the plate 10. The main fold line 222 is close to the rear end of the plate 10.

Figure 14:
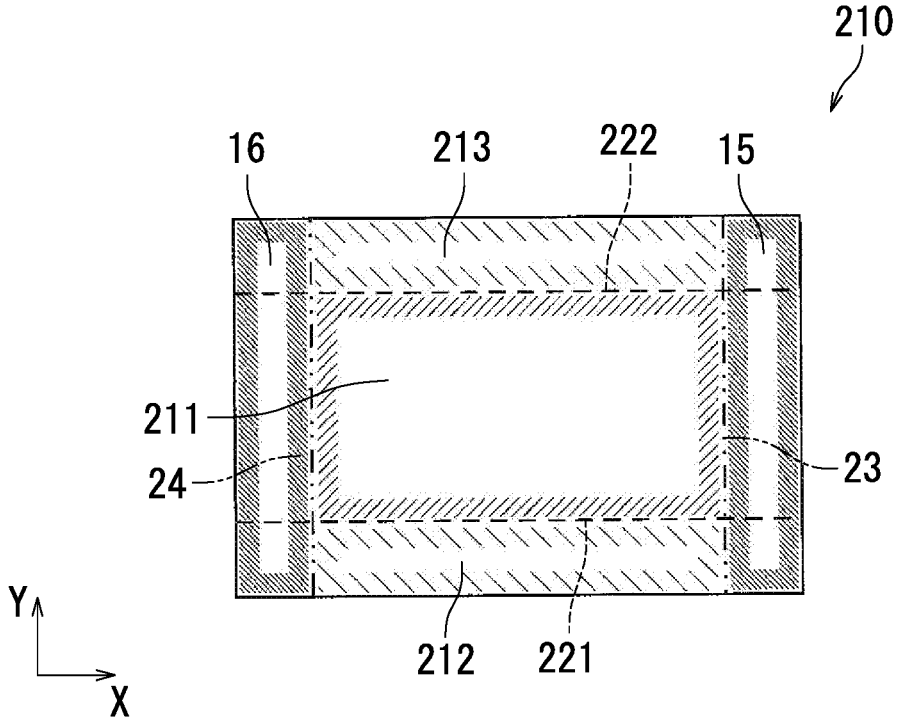
FIG. 14 is a plan view schematically illustrating a plate.

FIG. 14 is a plan view schematically illustrating the plate 210.

As illustrated in FIG. 14, the plate 210 has five portions, that is, a placement surface portion 211 on which the article 50 to be packaged is to be placed, two adjacent surface portions 212 and 213 adjacent to the placement surface portion 211, and the two stand-up portions 15 and 16.

The placement surface portion 211 and the adjacent surface portion 212 are defined by the front-side main fold line 221 located therebetween. The placement surface portion 211 and the adjacent surface portion 213 are defined by the rear-side main fold line 222 located therebetween. The adjacent surface portion 212, the placement surface portion 211, and the adjacent surface portion 213 are arranged in the noted order from the front side of the plate 210 except the right and left stand-up portions 15 and 16.

The plate 210 is configured such that the adjacent surface portion 212 and front parts of the stand-up portions 15 and 16 can be folded relative to the placement surface portion 211 along the main fold line 221. Also, the adjacent surface portion 212 and rear parts of the stand-up portions 15 and 16 can be folded relative to the placement surface portion 211 along the main fold line 222.

Referring again to FIG. 12, the film 30 is placed to surround mainly the placement surface portion 211 and the adjacent surface portions 212 and 213 of the plate 210. The film 30 is lapped around the plate 210 such that the main fold lines 221 and 222 pass through a tube that the film 30 forms.

Next, a method for packaging the article 50 using the packaging kit 201 will be described. The packaging method is generally the same as that of the first embodiment.

Figure 15:
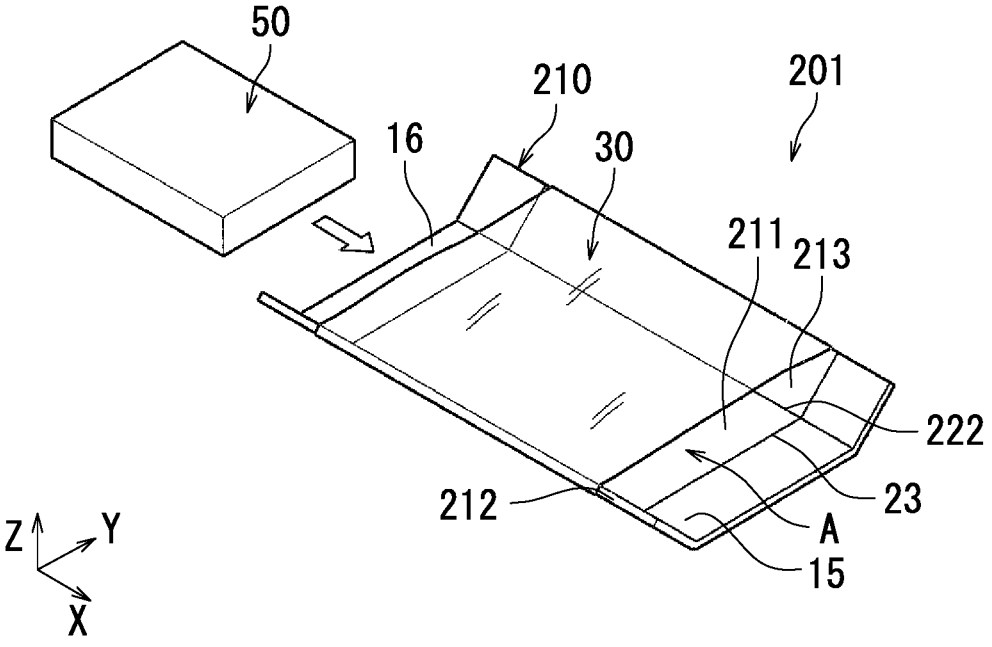
FIG. 15 is a perspective view illustrating the packaging kit in a state where the plate is folded.

FIG. 15 is a perspective view illustrating the packaging kit 201 in a state where the plate 210 is folded.

When the packaging kit 201 is brought into a folded state by folding the adjacent surface portions 212 and 213 relative to the placement surface portion 211 as illustrated in FIG. 15, the article 50 can be placed in a space A between the film 30 and the upper surface of the plate 210. That is, when the plate 210 is brought into the folded state, a course of a straight line that connects the front and rear ends of the plate 210 over the respective folds on the main fold lines 221 and 222 when viewed from a side is shorter than in an unfolded state. In the folded state, a difference between the length of the above course and the circumferential length of the film 30 becomes large, resulting in formation of the space A among the film 30, the adjacent surface portions 212 and 213 and the placement surface portion 211. The article 50 to be packaged can be placed in the above space A.

Figure 16:
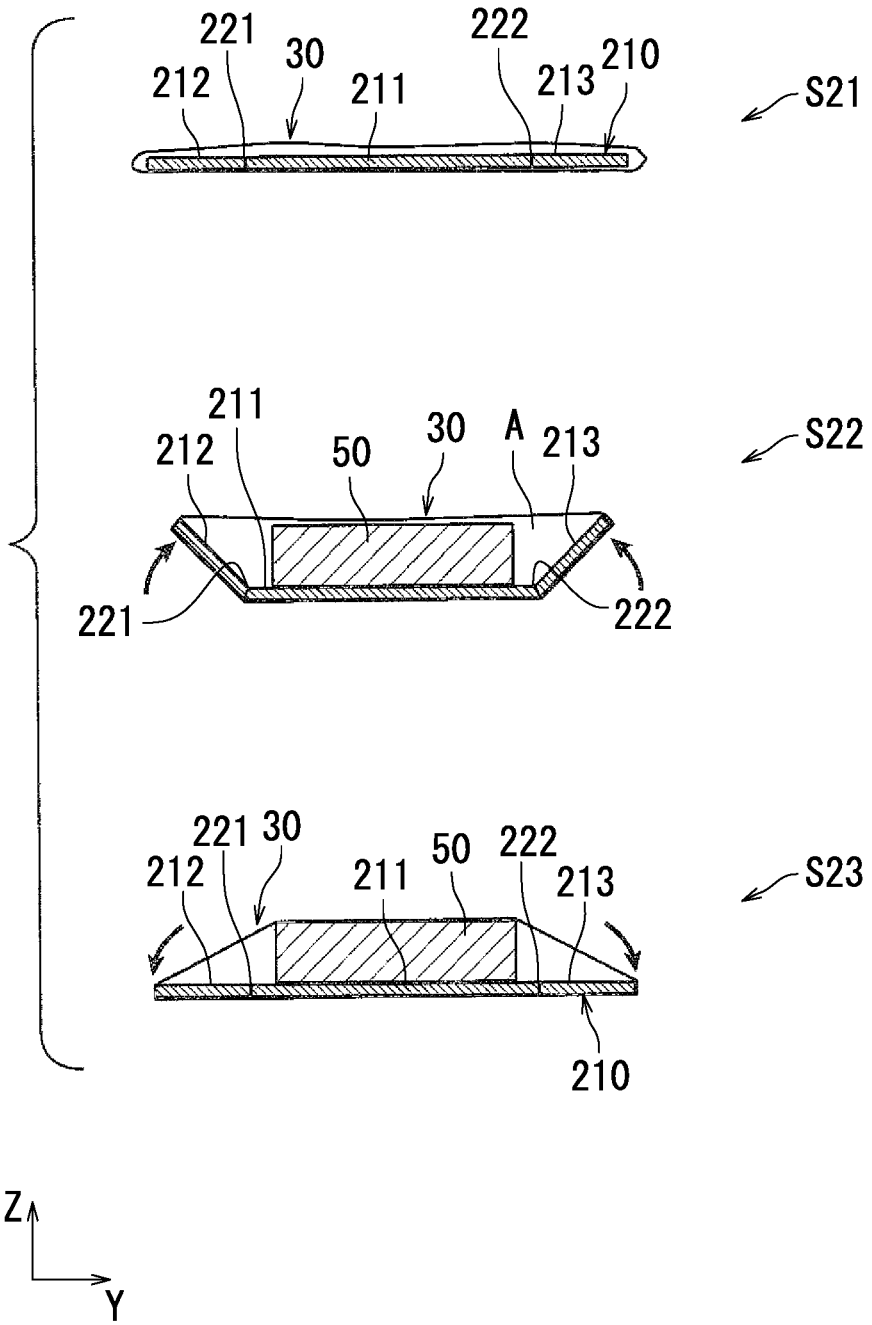
FIG. 16 is a diagram for explaining a packaging method using the packaging kit.

FIG. 16 is a diagram explaining a packaging method using the packaging kit 201.

FIG. 16 illustrates cross sections taken along a line B-B in FIG. 12. Packaging using the packaging kit 201 is performed through the following steps S21, S22, and S23 in order as illustrated from top to bottom in FIG. 16.

As illustrated in FIG. 16, the packaging kit 201 is flat in the unfolded state (S21). From the unfolded state, the packaging kit 201 is brought into the folded state by folding the plate 210 along the main fold lines 221 and 222 as indicated by up arrows in FIG. 16 (folding step).

Then, the article 50 is placed in the space A between the film 30 and the placement surface portion 211 in the state where the plate 210 is folded (S22; placing step).

Thereafter, the packaging kit 201 is brought into the unfolded state by unfolding the adjacent surface portions 212 and 213 relative to the placement surface portion 211 as indicated by down arrows in FIG. 16 (S23). Through the above, the film 30 is tightened while in contact with an upper part of the article 50. As a result, the article 50 is pressed against the plate 210 (unfolding step).

Figure 17:
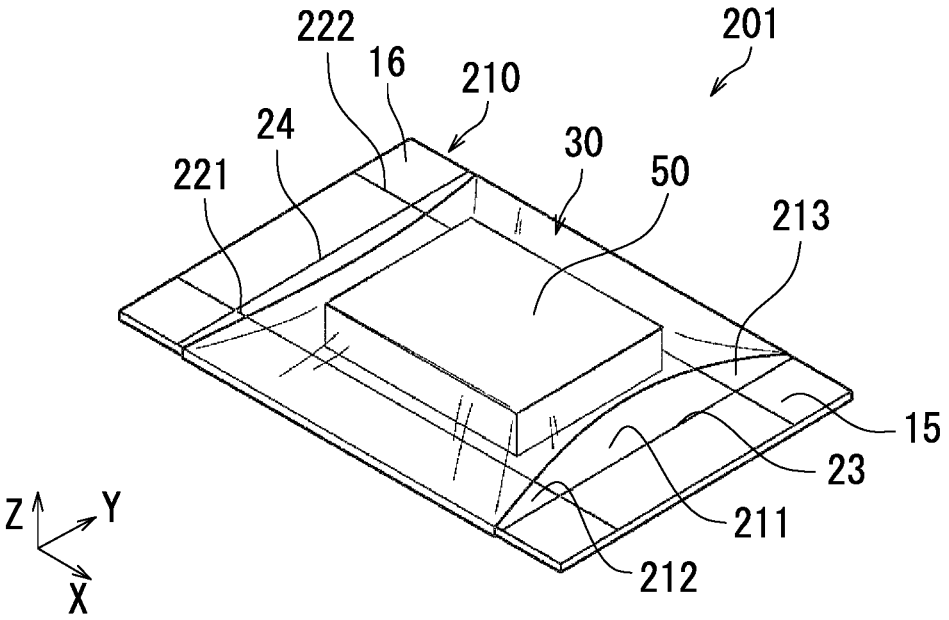
FIG. 17 is a perspective view illustrating the packaging kit in an unfolded state after packaging.

FIG. 17 is a perspective view illustrating the packaging kit 201 in an unfolded state after the packaging.

After the unfolding step, a course of straight lines that connect the front and rear ends of the plate 210 and the upper part of the article 50 over the folds on the main fold lines 221 and 222 when viewed from a side is longer than in the initial unfolded state since the article 50 is placed as illustrated in FIG. 17. The film 30 in contact with the upper part of the article 50 slightly stretches while being tightened. Therefore, the article 50 is pressed against the plate 210 by the film 30.

In also the unfolding step of the second embodiment performed as described above (or after the unfolding step), the stand-up portions 15 and 16 can be folded relative to the placement surface portion 11 along the sub-fold lines 23 and 24 to stand up (raising step).

Figure 18:
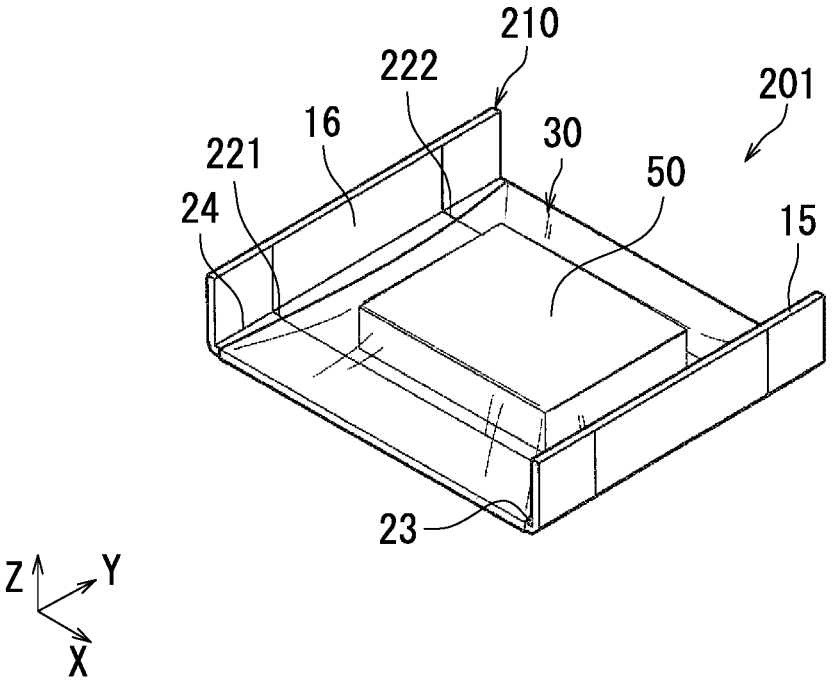
FIG. 18 is a perspective view illustrating a state where stand-up portions are raised.

FIG. 18 is a perspective view illustrating a state where the stand-up portions 15 and 16 are raised.

When the stand-up portions 15 and 16 are kept folded substantially perpendicularly to the placement surface portion 211 as illustrated in FIG. 18, the film 30 of the packaging kit 201 is kept tightened. Therefore, the article 50 is surely held in position on the plate 210.

As described above, in the second embodiment, the article 50 can be placed in the space A in a state where the adjacent surface portions 212 and 213 respectively located in front and rear of the placement surface portion 211 are folded. The article 50 can be held in position by bringing the plate 210 into the unfolded state. Therefore, the article 50 can be packaged easily, and other advantages similar to those achieved in the first embodiment can also be achieved.

Further, in the second embodiment, the placement surface portion 211 can be easily kept substantially horizontal even in the folded state. Therefore, the article 50 can be placed more easily. Also, the placement surface portion 211 is located at the center in the front-rear direction. Therefore, the article 50 can be placed so as not to overlap the main fold lines 221 and 222. As a result, the plate 210 can be brought from the folded state into the unfolded state without changing a position and a posture of the article 50 relative to the placement surface portion 211. The article 50 can be easily placed in an intended position on the placement surface portion 211.

It should be noted that in the second embodiment, similarly to the first embodiment, packaging may be performed using a jig or the packaging kit 201 may be used in a packaging line together with a jig.

Figure 19:
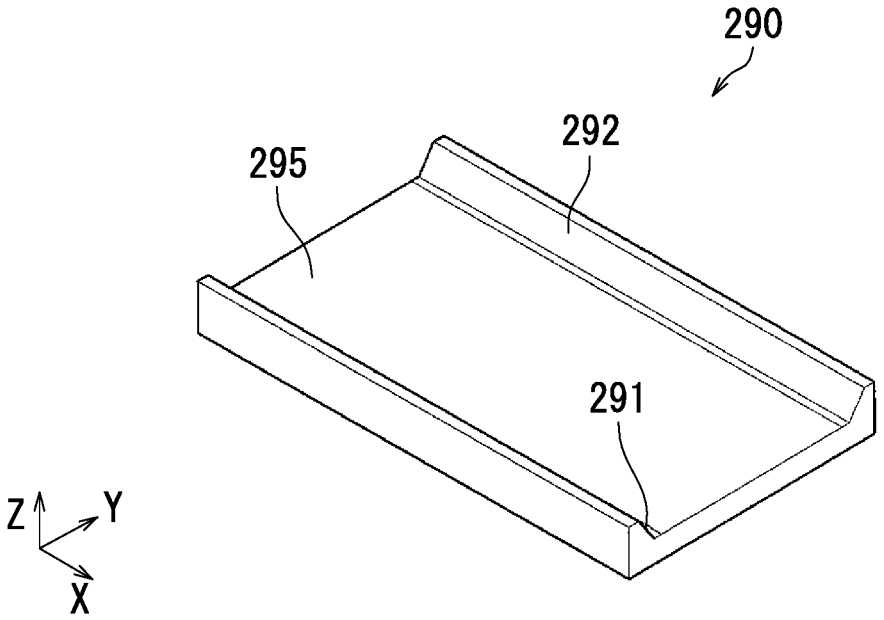
FIG. 19 is a perspective view illustrating an example of a jig used for performing packaging using the packaging kit.

FIG. 19 is a perspective view illustrating an example of a jig 290 used for performing packaging using the packaging kit 201.

As illustrated in FIG. 19, the jig 290 is in the form of a block made from resin, for example. The jig 290 has, as its upper surfaces, a substantially horizontal main support surface 295 and sub-support surfaces 291 and 292 respectively corresponding to the placement surface portion 211 and the adjacent surface portions 212 and 213 of the packaging kit 201. The sub-support surfaces 291 and 292 are each formed at a specific angle with respect to the main support surface 295. The jig 290 as a whole has a shape including protrusions respectively protruding upward from the front and rear edges of the main support surface 295.

Figure 20:
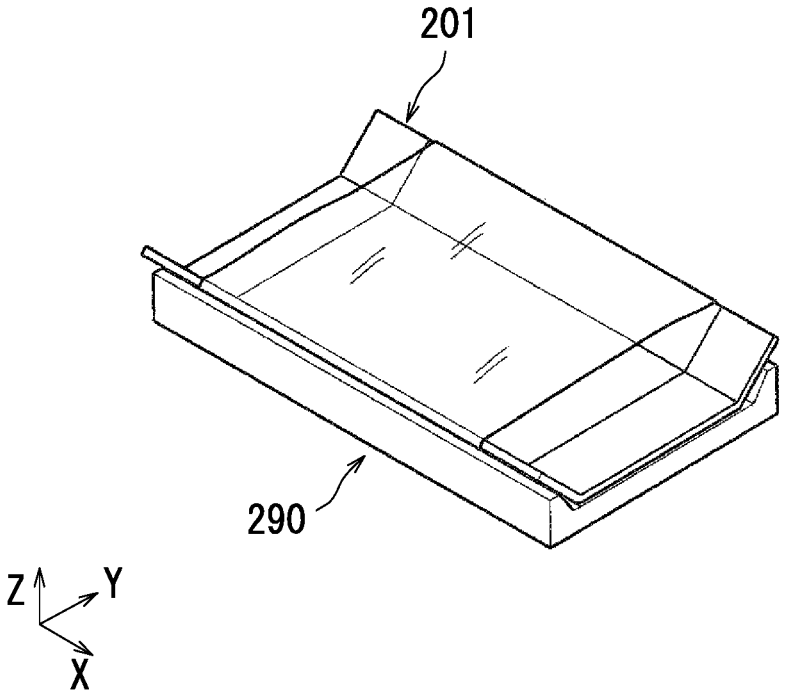
FIG. 20 is a perspective view illustrating an example of use of the jig.

FIG. 20 is a perspective view illustrating an example of use of the jig 290.

As illustrated in FIG. 20, the packaging kit 201 is placed on the upper surfaces of the jig 290. The placement surface portion 211 and the adjacent surface portions 212 and 213 of the packaging kit 201 are supported by the support surfaces 291, 292, and 295 of the jig 290, respectively, and the plate 210 is held in the folded state. Therefore, packaging can be performed efficiently using the jig 290 similarly to in the first embodiment. The jig 290 can be used for example in a situation in which the packaging kit 201 is used in a packaging line. The jig 290 may also be used in a situation in which packaging is performed manually.

In the second embodiment, the width of the main support surface 295 in the front-rear direction may be made larger than the width of the placement surface portion 211. In a configuration in which there is a space between the main support surface 295 and the placement surface portion 211, packaging can be performed easily by setting the packaging kit 201 on the jig 290 without considering any slight displacement of the packaging kit 201 relative to the jig 290. In the above configuration, the sub-support surfaces 291 and 292 may each be formed at an angle closer to the right angle with respect to the placement surface portion 211, or the sub-support surfaces 291 and 292 may each be formed to protrude further from the placement surface portion 211.

Third Embodiment

The basic structure of a packaging kit according to a third embodiment is the same as that of the packaging kit according to the first embodiment, and description of which will not be repeated. The third embodiment differs from the first embodiment in that stand-up portions are each partitioned by an auxiliary fold line in the third embodiment.

Figure 21:
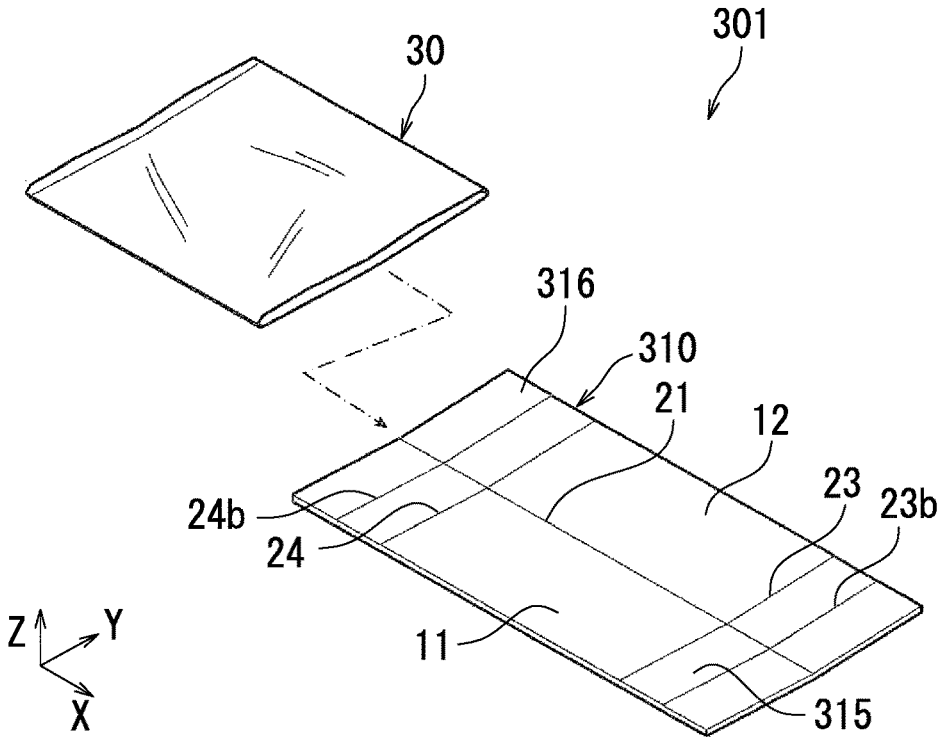
FIG. 21 is an exploded perspective view of a packaging kit according to a third embodiment.

FIG. 21 is an exploded perspective view of a packaging kit 301 according to the third embodiment.

As illustrated in FIG. 21, the packaging kit 301 is formed from a plate 310 (an example of the plate-shaped member) and the tubular film 30 attached thereto.

Figure 22:
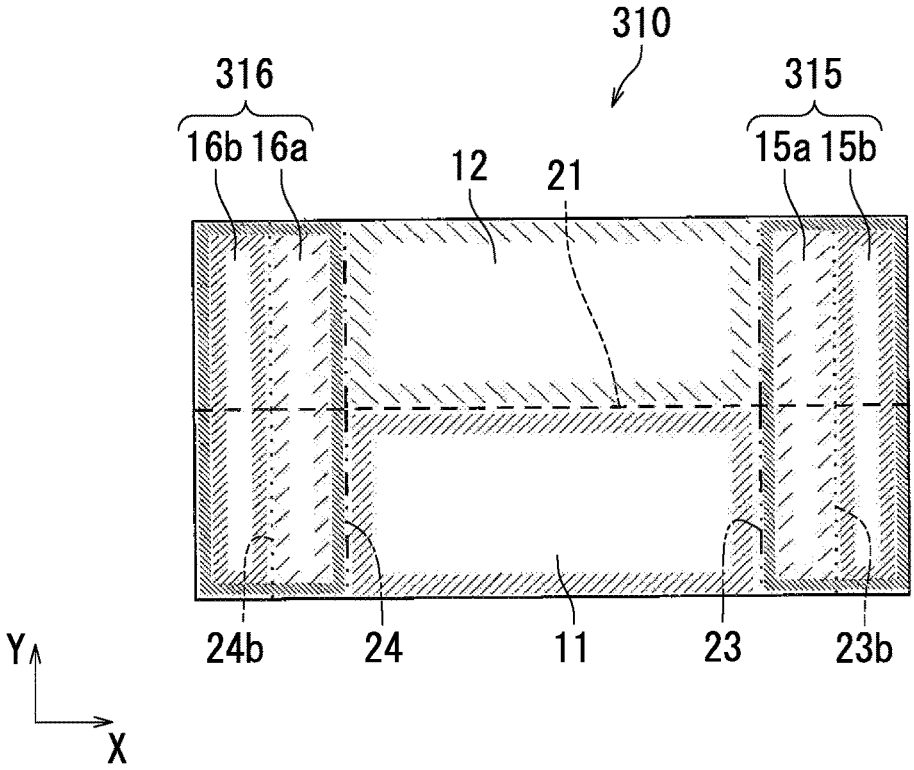
FIG. 22 is a plan view schematically illustrating a plate.

FIG. 22 is a plan view schematically illustrating the plate 310.

As illustrated in FIG. 22, the plate 310 includes the placement surface portion 11 on which the article 50 to be packaged is to be placed, the adjacent surface portion 12 adjacent to the placement surface portion 11, and two stand-up portions 315 and 316. The main fold line 21 is located between the placement surface portion 11 and the adjacent surface portion 12. The sub-fold line 23 is located between the right stand-up portion 315 and each of the placement surface portion 11 and the adjacent surface portion 12. The sub-fold line 24 is located between the left stand-up portion 316 and each of the placement surface portion 11 and the adjacent surface portion 12.

An auxiliary fold line 23*b* (indicated by a short dashed line) is formed in the stand-up portion 315 in the present embodiment. The auxiliary fold line 23*b* is substantially parallel with the sub-fold line 23. The stand-up portion 315 is further partitioned into two portions by the auxiliary fold line 23*b*. That is, a vertical portion 15*a* adjacent to the placement surface portion 11 and a horizontal portion 15*b* adjacent to the vertical portion 15*a* are defined by the auxiliary fold line 23*b* located between the vertical portion 15*a* and the horizontal portion 15*b*.

Also, an auxiliary fold line 24*b* (indicated by a short dashed line) is formed in the stand-up portion 316. The auxiliary fold line 24*b* is substantially parallel with the sub-fold line 24. The stand-up portion 316 is further partitioned into two portions by the auxiliary fold line 24*b*. That is, a vertical portion 16*a* adjacent to the placement surface portion 11 and a horizontal portion 16*b* adjacent to the vertical portion 16*a* are defined by the auxiliary fold line 24*b* located between the vertical portion 16*a* and the horizontal portion 16*b*.

Similarly to in the first embodiment, the article 50 can be secured on the placement surface portion 11 by performing steps up to raising of the stand-up portions 315 and 316 using the packaging kit 301. When at least the vertical portions 15*a* and 16*a* of the stand-up portions 315 and 316 are kept folded relative to the placement surface portion 11, the film 30 of the packaging kit 301 is kept tightened. As a result, the article 50 is surely held in position on the plate 210. The vertical portions 15*a* and 16*a* are folded for example perpendicularly to the placement surface portion 11.

Figure 23:
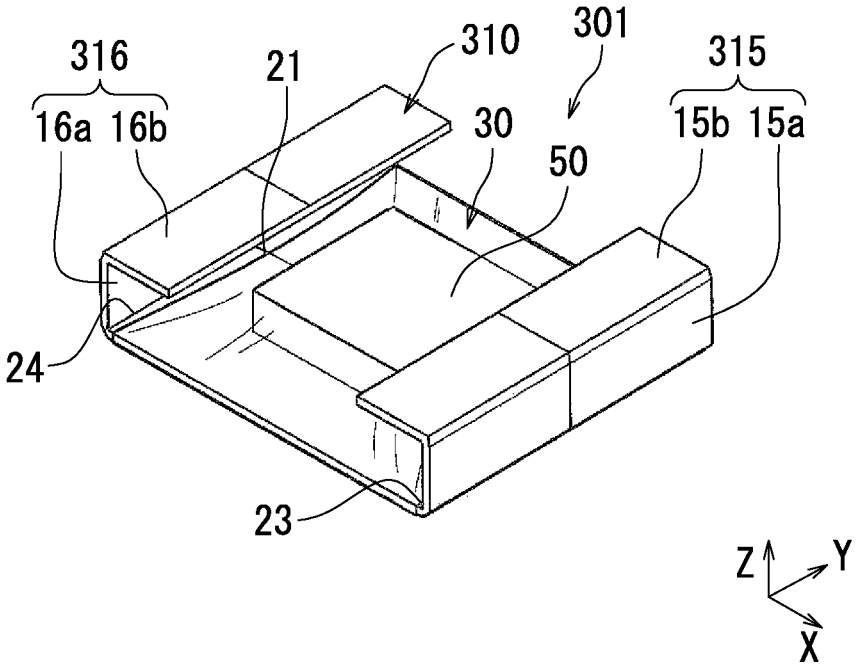
FIG. 23 is a perspective view illustrating a state where stand-up portions are raised.

FIG. 23 is a perspective view illustrating a state where the stand-up portions 315 and 316 are raised.

As illustrated in FIG. 23, the horizontal portions 15*b* and 16*b* of the stand-up portions 315 and 316 in the third embodiment can be respectively folded along the auxiliary fold lines 23*b* and 24*b* relative to the respective vertical portions 15*a* and 16*a*. The horizontal portions 15*b* and 16*b* are respectively folded relative to the vertical portions 15*a* and 16*a* for example to be parallel with the placement surface portion 11, that is, to be parallel with a substantially horizontal surface. That is, as illustrated in FIG. 23, the plate 310 is folded such that the horizontal placement surface portion 11, the horizontal portion 15*b*, and the vertical portion 15*a* form a rectangular U-shape (shape of a Japanese katakana letter "ko") when viewed from the front. Similarly, the plate 310 is folded such that the horizontal placement surface portion 11, the horizontal portion 16*b*, and the vertical portion 16*a* form a rectangular U-shape when viewed from the front.

Figure 24:
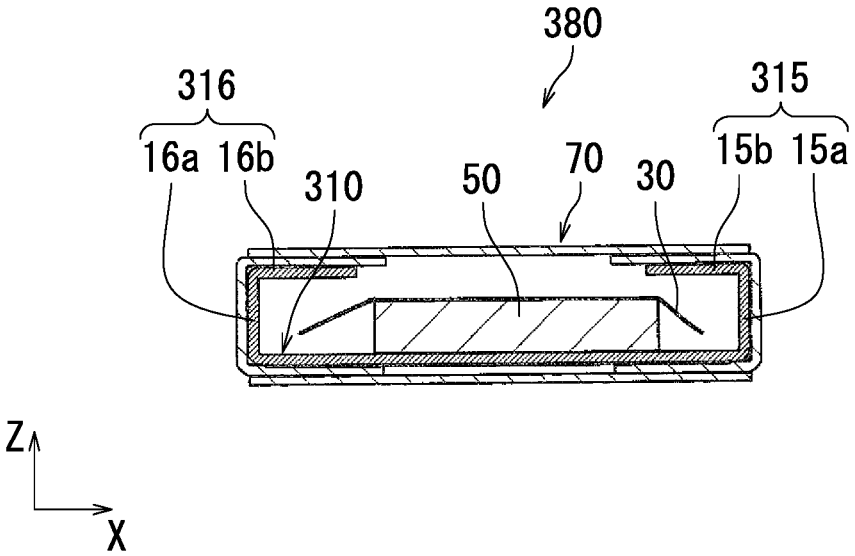
FIG. 24 is a diagram illustrating an example of a package.

FIG. 24 is a diagram illustrating an example of a package 380.

The package 380 illustrated in FIG. 24 is constituted by the packaging kit 301 holding the article 50 and the outer casing 70 accommodating the packaging kit 301. The height of each of the vertical portions 15*a* and 16*a* is determined to match the height of the inside of the outer casing 70. In other words, a distance between the sub-fold line 23 and the auxiliary fold line 23*b* and a distance between the sub-fold line 24 and the auxiliary fold line 24*b* are determined to match the height of the inside of the outer casing 70. As a result, when the packaging kit 301 is accommodated in the outer casing 70, the stand-up portions 315 and 316 are kept folded as described above, as illustrated in FIG. 24. In the above configuration, the vertical portions 15*a* and 16*a* fit respective side faces of the outer casing 70 and the horizontal portions 15*b* and 16*b* fit the top surface of the outer casing 70. Therefore, the outer casing 70 is supported by the packaging kit 301 and the package 380 becomes tough. Specifically, the horizontal portions 15*b* and 16*b* fit the top surface of the outer casing 70. Therefore, the top surface of the outer casing 70 can be firmly supported even when a strong impact is applied to the outer casing 70 from above. As a result, impact resistance of the package 380 can be improved.

As described above, in also the third embodiment, the article 50 can be placed in the space A in a state where the placement surface portion 11 and the adjacent surface portion 12 are folded to come close to each other. The article 50 can be held in position by bringing the plate 310 into the unfolded state. Therefore, the article 50 can be packaged easily, and other advantages similar to those achieved in the first embodiment can also be achieved.

Further, in the third embodiment, the stand-up portions 315 and 316 can be folded along the sub-fold lines 23 and 24 and the auxiliary fold lines 23*b* and 24*b* to form the rectangular U-shape when viewed from the front, as described above. Therefore, the packaging kit 301 and the package 380 including the outer casing 70 that accommodates the packaging kit 301 can have improved impact resistance.

Others

The number and position of the main fold line(s) and the number and position of the sub-fold lines are not limited to those described above. It is only required that at least one main fold line is provided. The sub-fold lines need not be necessarily provided. That is, it is only required that the placement surface portion and one or two adjacent surface portions adjacent to the placement surface portion are provided. Also, there may be another adjacent surface portion that is adjacent to one of the adjacent surface portion(s) and that can be folded relative to the one of the adjacent surface portion(s) in a folded state. Only one stand-up portion may be provided or the stand-up portions may be absent. In any of the above configurations, an article can be secured by bringing the plate into the unfolded state after the article is placed in a space formed by bringing the plate into the folded state, with a result that packaging can be performed easily.

Figure 25:
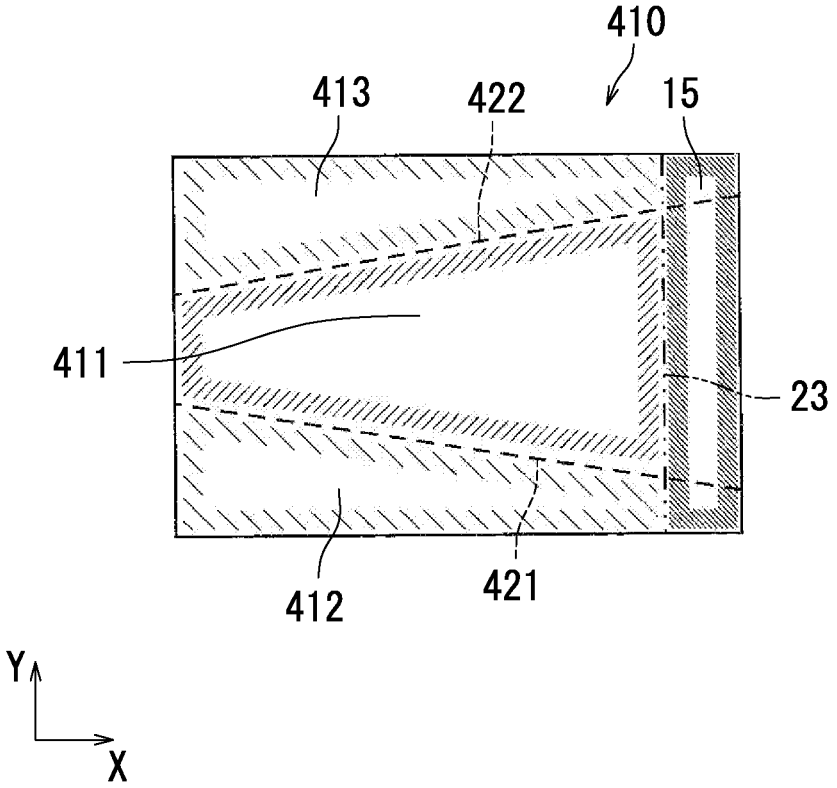
FIG. 25 is a diagram schematically illustrating a plate of a packaging kit according to a variation of the second embodiment.

FIG. 25 is a diagram schematically illustrating a plate 410 of a packaging kit according to a variation of the second embodiment.

As illustrated in FIG. 25, the plate 410 has two main fold lines 421 and 422 and the sub-fold line 23. The two main fold lines 421 and 422 are arranged so as not to intersect with each other on the plate 410. In this variation, the main fold lines 421 and 422 are each slanted relative to the X axis. That is, the main fold lines 421 and 422 are arranged substantially symmetrically with respect to the center line in the front-rear direction of the plate 410. A distance between the main fold lines 421 and 422 in the front-rear direction increases from the left to the right. The sub-fold line 23 is located near the right end of the plate 410. The sub-fold line 23 intersects with the main fold lines 421 and 422 on the plate 410.

The plate 410 is partitioned into a trapezoidal placement surface portion 411, two adjacent surface portions 412 and 413, and the stand-up portion 15. A packaging kit in which a tubular film is lapped around the plate 410 can be used for packaging an article, as described above. Although the stand-up portion 15 is provided only on the right, the placement surface portion 411 and the two adjacent surface portions 412 and 413 can be kept unfolded and substantially in plane with one another by raising the stand-up portion 15.

Fourth Embodiment

The basic structure of a packaging kit according to a fourth embodiment is the same as that of the packaging kit according to the first embodiment, and description of which will not be repeated. Roughly speaking, the fourth embodiment differs from the first embodiment in that the main fold line 21 is displaced rearward from the center of a plate 510 in the front-rear direction and open ends of a film overlap the stand-up portions in the fourth embodiment.

Figure 26:
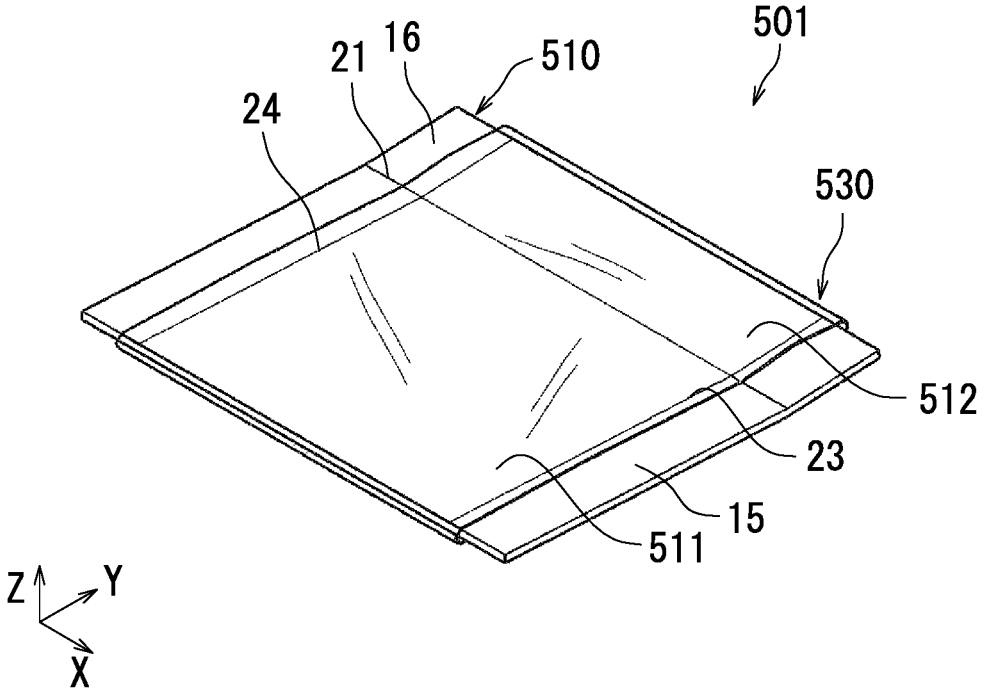
FIG. 26 is a perspective view of a packaging kit according to a fourth embodiment of the present invention.

FIG. 26 is a perspective view illustrating a packaging kit 501 according to the fourth embodiment.

As illustrated in FIG. 26, the packaging kit 501 includes the plate (an example of the plate-shaped member) 510 and a film 530. The basic structure of the packaging kit 501 is the same as that of the above-described packaging kit 1. The film 530 is lapped around the plate 510.

The plate 510 in the fourth embodiment differs from the plate 10 in the following points. The main fold line 21 is displaced rearward from the center of the plate 510 in the front-rear direction. That is, the main fold line 21 is located at a position shifted from the center of the plate 510. Therefore, the placement surface portion 511 is larger than the adjacent surface portion 512. That is, the placement surface portion 511 has an area larger than that of the adjacent surface portion 512.

The following advantage can be achieved by the rearward displacement of the main fold line 21. That is, the placement surface portion 511 has a large area and the center of gravity of the packaging kit 501 is located in front of the main fold line 21. Therefore, when the packaging kit 501 is brought into a folded state on a substantially horizontal table or the like, the placement surface portion 511 can be easily kept placed on the table. Therefore, packaging can be performed easily without using a special jig or the like.

Figure 27:
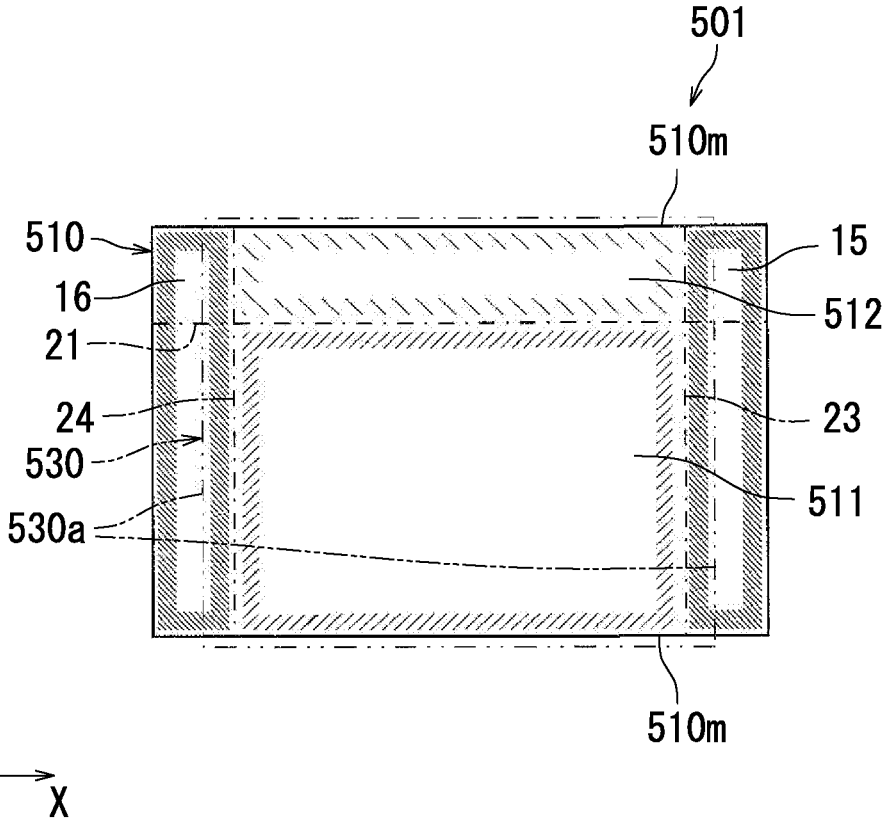
FIG. 27 is a plan view schematically illustrating the packaging kit.

FIG. 27 is a plan view schematically illustrating the packaging kit 501.

Corresponding portions are hatched in FIG. 27 in the same manner as in FIG. 3. In FIG. 27, the film 530 is indicated by a dash-dot-dot line. The main fold line 21 and the sub-fold lines 23 and 24 are each indicated by a dash-dot line.

When the packaging kit 501 is in the unfolded state, right and left open ends 530*a* of a tube that the film 530 forms overlap the stand-up portions 15 and 16. Specifically, the open ends 530*a* overlap parts of the stand-up portions 15 and 16 respectively near the sub-fold lines 23 and 24. In other words, the length of the film 530 (length of the tube) is larger than the respective widths of the placement surface portion 511 and the adjacent surface portion 512 in the left-right direction.

Paired edges 510*m* of the plate 510 are straight. The placement surface portion 511 is rectangular. The adjacent surface portion 512 is rectangular.

Figure 28:
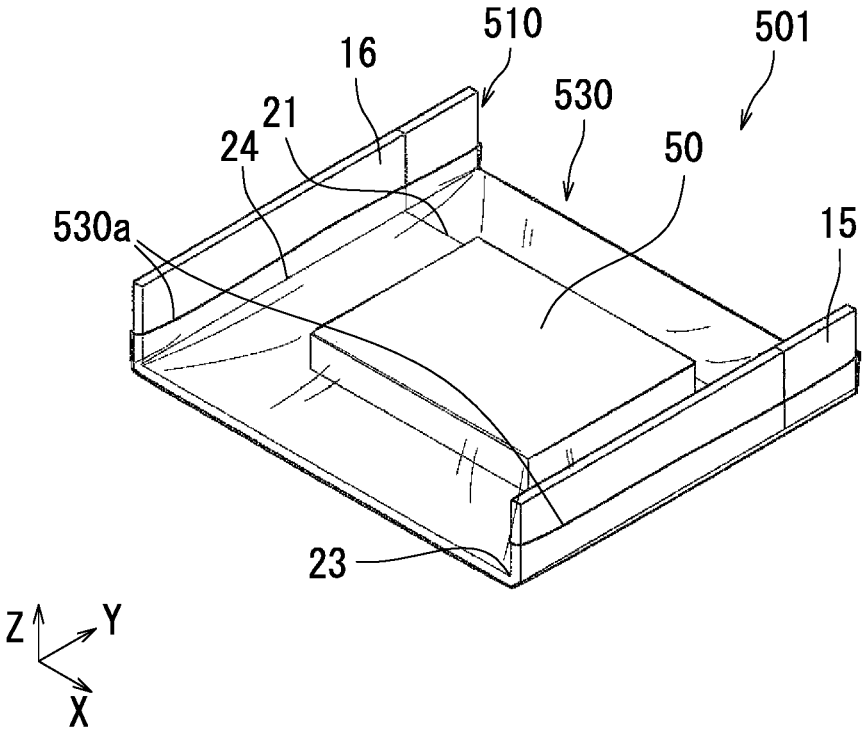
FIG. 28 is a perspective view illustrating an example of the packaging kit in a state where stand-up portions are raised after packaging.

FIG. 28 is a perspective view illustrating an example of the packaging kit 501 in a state where the stand-up portions 15 and 16 are raised after packaging.

In also the fourth embodiment, an article can be packaged similarly to in the first embodiment. FIG. 28 illustrates a state where the stand-up portions 15 and 16 are raised relative to the placement surface portion 511 after the packaging kit 501 is unfolded in a state where the article 50 is placed on the placement surface portion 511. As illustrated in FIG. 28, the article 50 is pressed against the plate 510 by the film 530 and surely held on the plate 510.

In the above configuration, the respective open ends 530*a* of the film 530 overlap the stand-up portions 15 and 16. Therefore, when the stand-up portions 15 and 16 are folded relative to the placement surface portion 511, parts of the film 530 near its open ends 530*a* are also folded together with the stand-up portions 15 and 16 along the sub-fold lines 23 and 24. Through the above, there is formed a space surrounded by the film 530 and the placement surface portion 511 and the adjacent surface portion 512 of the plate 510. The above space can be kept airtight to some degree. Therefore, adhesion of a large particle of dust to the article 50 placed in the space can be prevented with a simple configuration.

The packaging kit 501 in a state as illustrated in FIG. 28 can be accommodated in an outer casing similarly to in the first embodiment.

Figure 29:
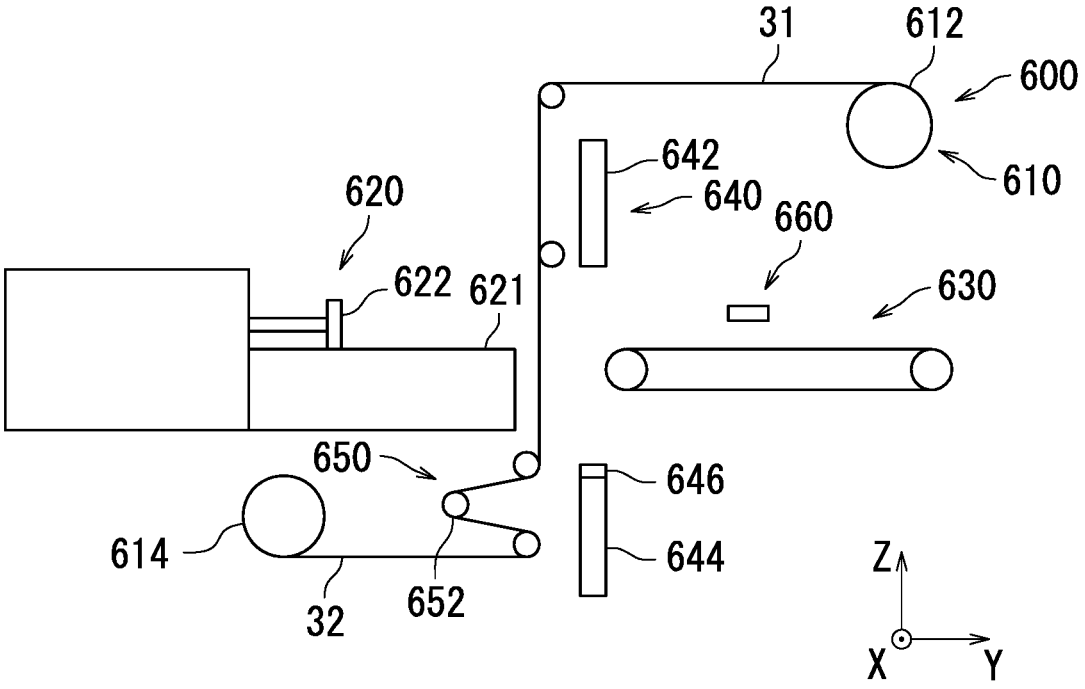
FIG. 29 is a side view schematically illustrating a packaging kit manufacturing apparatus according to an embodiment of the present invention.

A packaging kit manufacturing apparatus 600 according to an embodiment of the present invention will be described with reference to FIGS. 26 and 29. FIG. 29 is a side view schematically illustrating the packaging kit manufacturing apparatus 600 according to the embodiment of the present invention.

As illustrated in FIG. 29, the packaging kit manufacturing apparatus 600 includes a film feeding section 610, a conveyance section 620, a welding section 640, a retracting section 650, a lift restricting section 660, and a discharge section 630. The packaging kit manufacturing apparatus 600 manufactures a packaging kit. The packaging kit is for example the packaging kit 1 (FIG. 1A), the packaging kit 201 (FIG. 12), the packaging kit 301 (FIG. 21), or the packaging kit 501 (FIG. 26).

The following describes, as an example, the packaging kit manufacturing apparatus 600 and a packaging kit manufacturing method in a situation in which the packaging kit 501 is manufactured. As described above with reference to FIG. 26, the packaging kit manufacturing apparatus 600 includes the tubular film 530 and the plate 510. The main fold line 21 is formed on the upper surface of the plate 510. The film 530 (tubular film) is lapped around the plate 510.

The film feeding section 610 feeds films. The film feeding section 610 includes an upper-film feeding section 612 and a lower-film feeding section 614. The upper-film feeding section 612 feeds an upper film 31 in the form of a band above the plate 510 (not illustrated in FIG. 29). The lower-film feeding section 614 feeds a lower film 32 in the form of a band below the plate 510 (not illustrated in FIG. 29).

The conveyance section 620 includes a placement section 621 and a pushing section 622. The plate 510 is placed on the placement section 621. The conveyance section 620 conveys the plate 510 such that the leading end of the plate 510 pushes the films (the upper film 31 and the lower film 32). Specifically, the pushing section 622 pushes the trailing end of the plate 510 placed on the placement section 621 to convey the plate 510 in a horizontal direction.

The welding section 640 includes a sealing section 644 and a sealing section receiving section 642. The sealing section includes a heat source 646. The heat source 646 is a melt-cutting blade, for example. The sealing section receiving section 642 receives the sealing section 644. The welding section 640 welds together the upper film 31 and the lower film 32 to form the tubular film 530. Specifically, the upper film 31 and the lower film 32 are welded together to form the tubular film 530 by bringing the sealing section 644 and the sealing section receiving section 642 into contact with each other.

The retracting section 650 includes a retraction roller 652. The retracting section 650 retracts the lower film 32 to fold the plate 510 along the main fold line 21 before the welding section 640 welds together the upper film 31 and the lower film 32. Specifically, the retraction roller 652 moves in the Y axis direction, whereby the lower film 32 is retracted and the plate 510 is folded along the main fold line 21.

The lift restricting section 660 restricts lift of the leading end of the plate 510 when the lower film 32 is retracted by the retracting section 650.

The discharge section 630 discharges the plate 510 around which the film 530 is lapped, that is, the manufactured packaging kit 501. The discharge section 630 is a conveyor belt, for example.

Figure 30A:
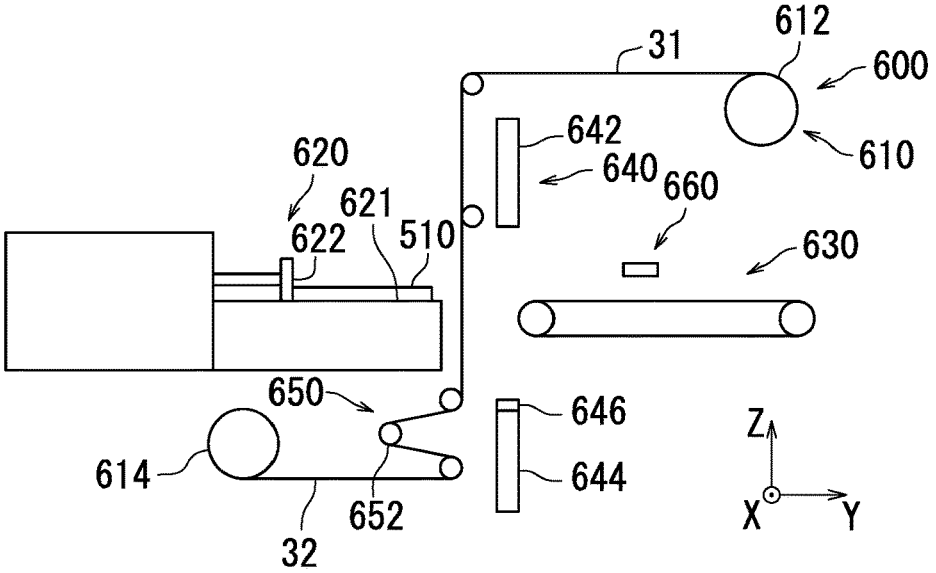
FIGS. 30A to 30C are side views schematically illustrating a packaging kit manufacturing method according to an embodiment of the present invention.
Figure 30B:
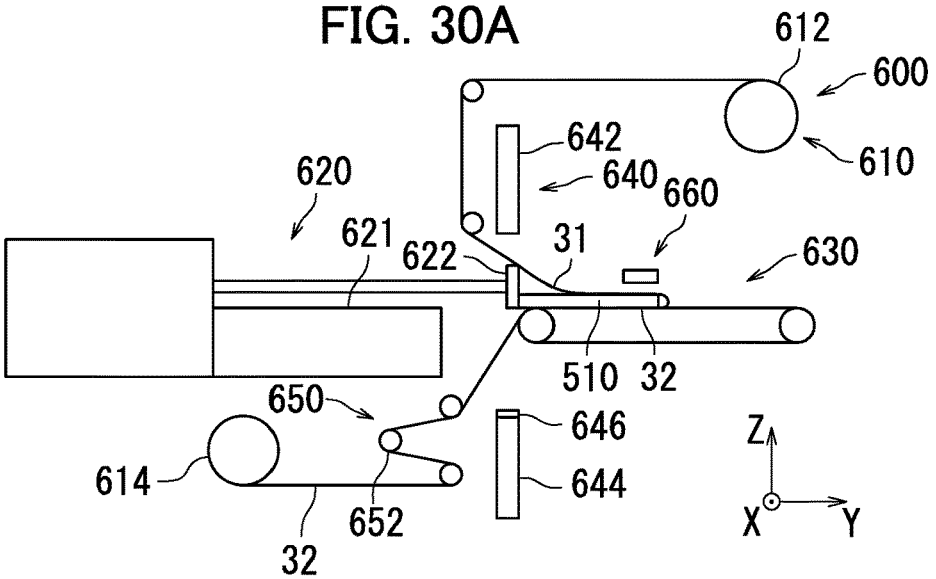
Figure 30C:
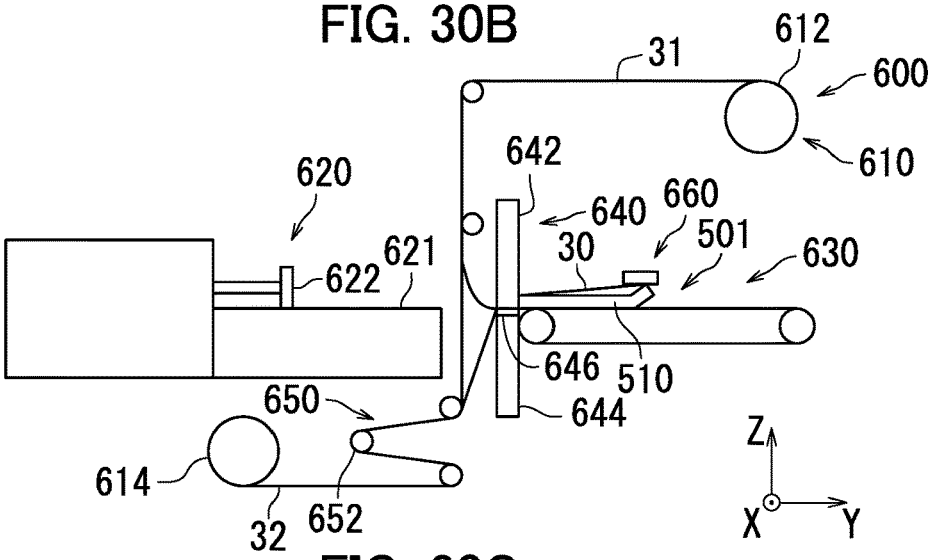
Figure 31:
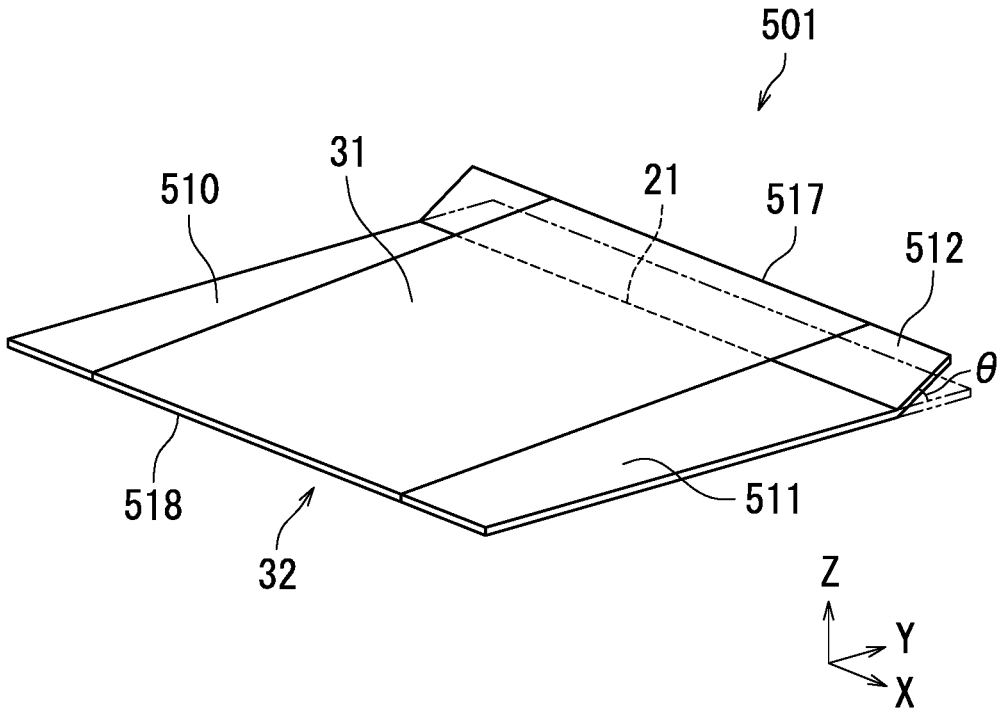
FIG. 31 is a perspective view illustrating a packaging kit according to an embodiment of the present invention.

A method for manufacturing the packaging kit 501 according to an embodiment of the present invention will be described with reference to FIGS. 26, 30A to 30C, and 31. FIGS. 30A to 30C are side views schematically illustrating the method for manufacturing the packaging kit 501 according to the embodiment of the present invention. FIG. 31 is a perspective view illustrating the packaging kit 501 according to the embodiment of the present invention.

As illustrated in FIG. 30A, the films (the upper film 31 and the lower film 32), the plate 510, and the packaging kit manufacturing apparatus 600 are prepared (preparation step). The plate 510 is placed on the placement section 621.

As illustrated in FIG. 30B, the leading end of the plate 510 pushes the upper film 31 and the lower film 32, whereby the upper film 31 and the lower film 32 are lapped around the plate 510 in a manner that the upper film 31 and the lower film 32 come in contact with the plate 510 from the leading end to the trailing end thereof (lapping step). Specifically, the pushing section 622 pushes the trailing end of the plate 510 to convey the plate 510. Respective leading edges of the upper film 31 and the lower film 32 are pulled forward through the conveyance of the plate 510. When the respective leading edges of the upper film 31 and the lower film 32 are pulled forward, the upper film 31 is fed above the plate 510 by the upper-film feeding section 612 and the lower film 32 is fed below the plate 510 by the lower-film feeding section 614. After completion of the conveyance of the plate 510 by the pushing section 622, the pushing section 622 returns to its initial position illustrated in FIG. 30A.

After the upper surface and the lower surface of the plate 510 are covered with the upper film 31 and the lower film 32, the lower film 32 is retracted to fold the plate 510 along the main fold line 21 until lift of the leading end of the plate 510 is restricted by the lift restricting section 660, as illustrated in FIG. 30C (retracting step). Specifically, when the lower film 32 is retracted, the leading end 517 of the plate 510 is folded along the main fold line 21, as illustrated in FIG. 31. When the lower film 32 is retracted, the upper film 31 is pulled tight between the leading end 517 and the trailing end 518 of the plate 510.

Referring again to FIG. 30C, after completion of the retracting step, the welding section 640 welds together the upper film 31 and the lower film 32 to form the tubular film 530, as illustrated in FIG. 30C (tubular film forming step). Specifically, the upper film 31 and the lower film 32 are welded together and cut by bringing the sealing section 644 and the sealing section receiving section 642 into contact with each other. The tubular film 530 is formed by the welding of the upper film 31 and the lower film 32. Through the above, the packaging kit 501 is manufactured.

The manufactured packaging kit 501 is discharged by the discharge section 630.

Figure 32A:
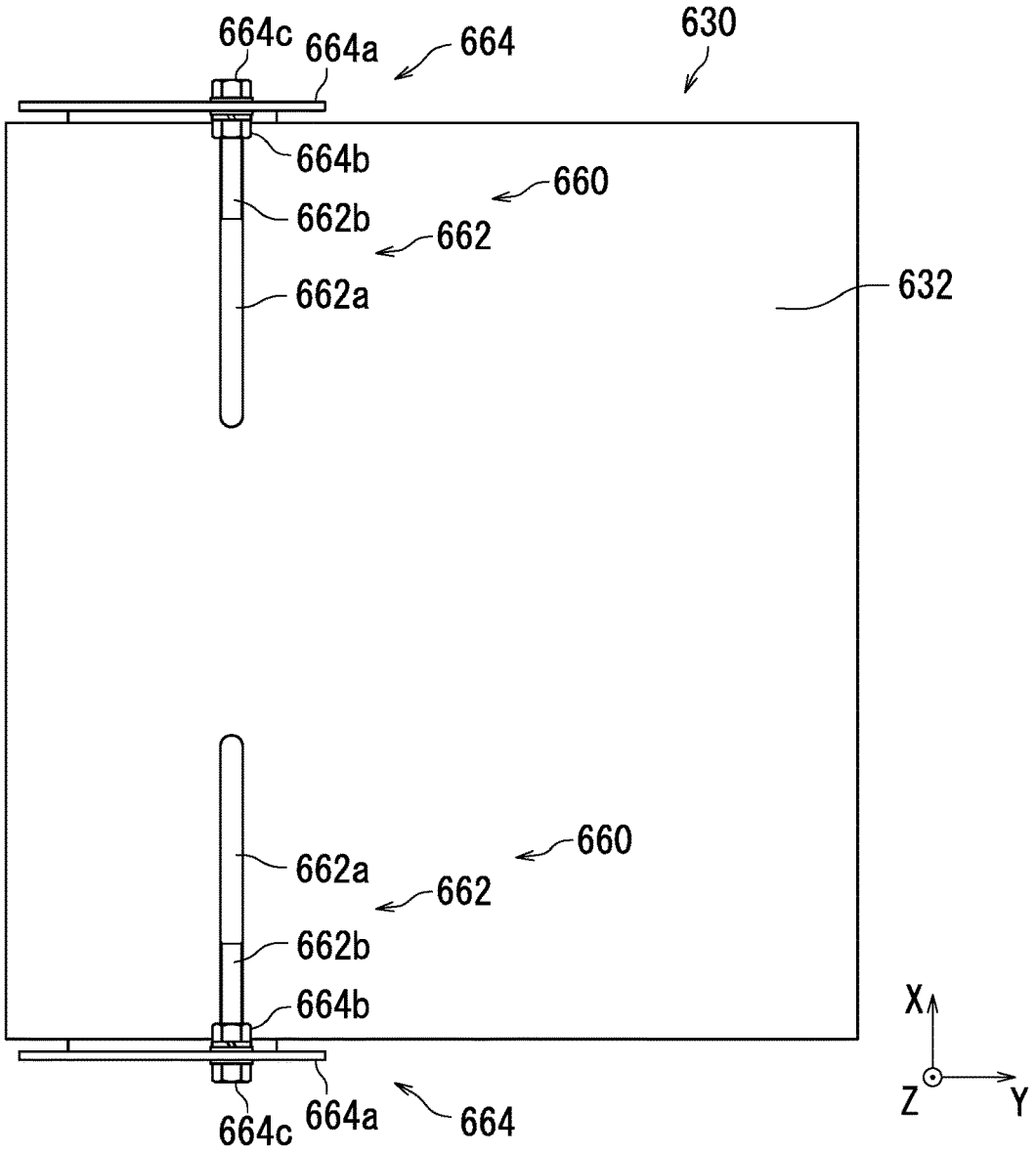
FIG. 32A is a plan view illustrating lift restricting sections.
Figure 32B:
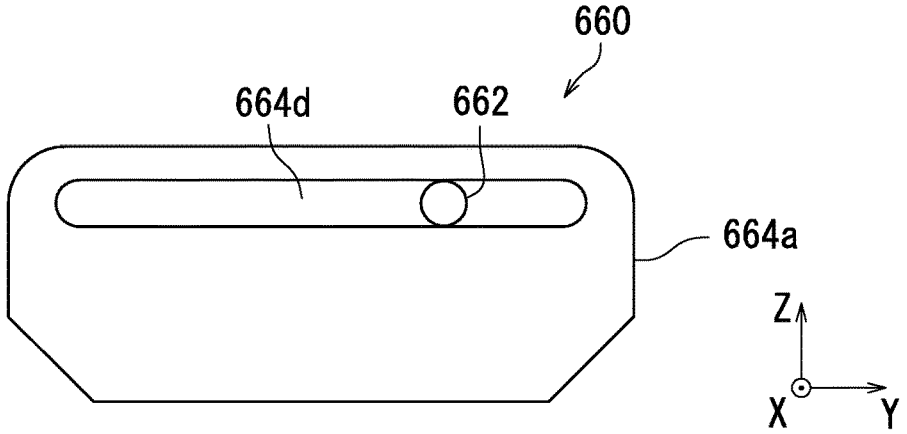
FIG. 32B is a side view illustrating one of the lift restricting sections.
Figure 33A:
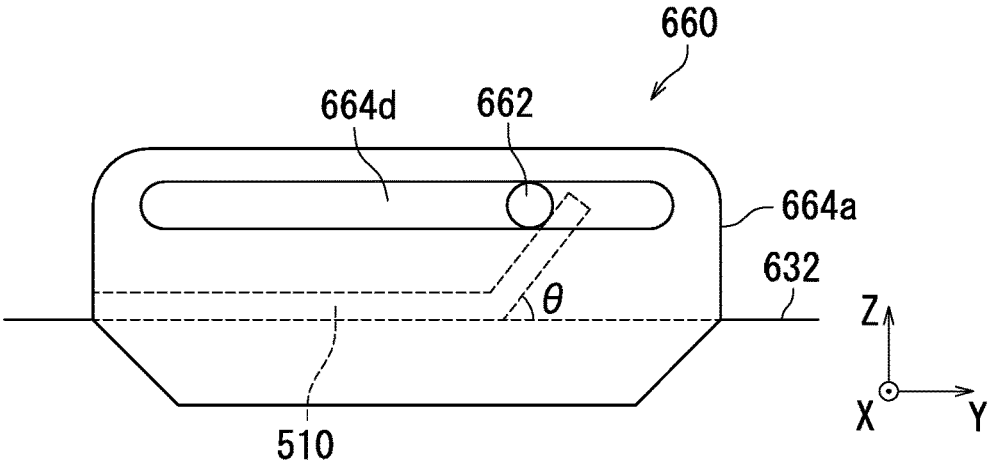
FIG. 33A is a side view illustrating the lift restricting section.
Figure 33B:
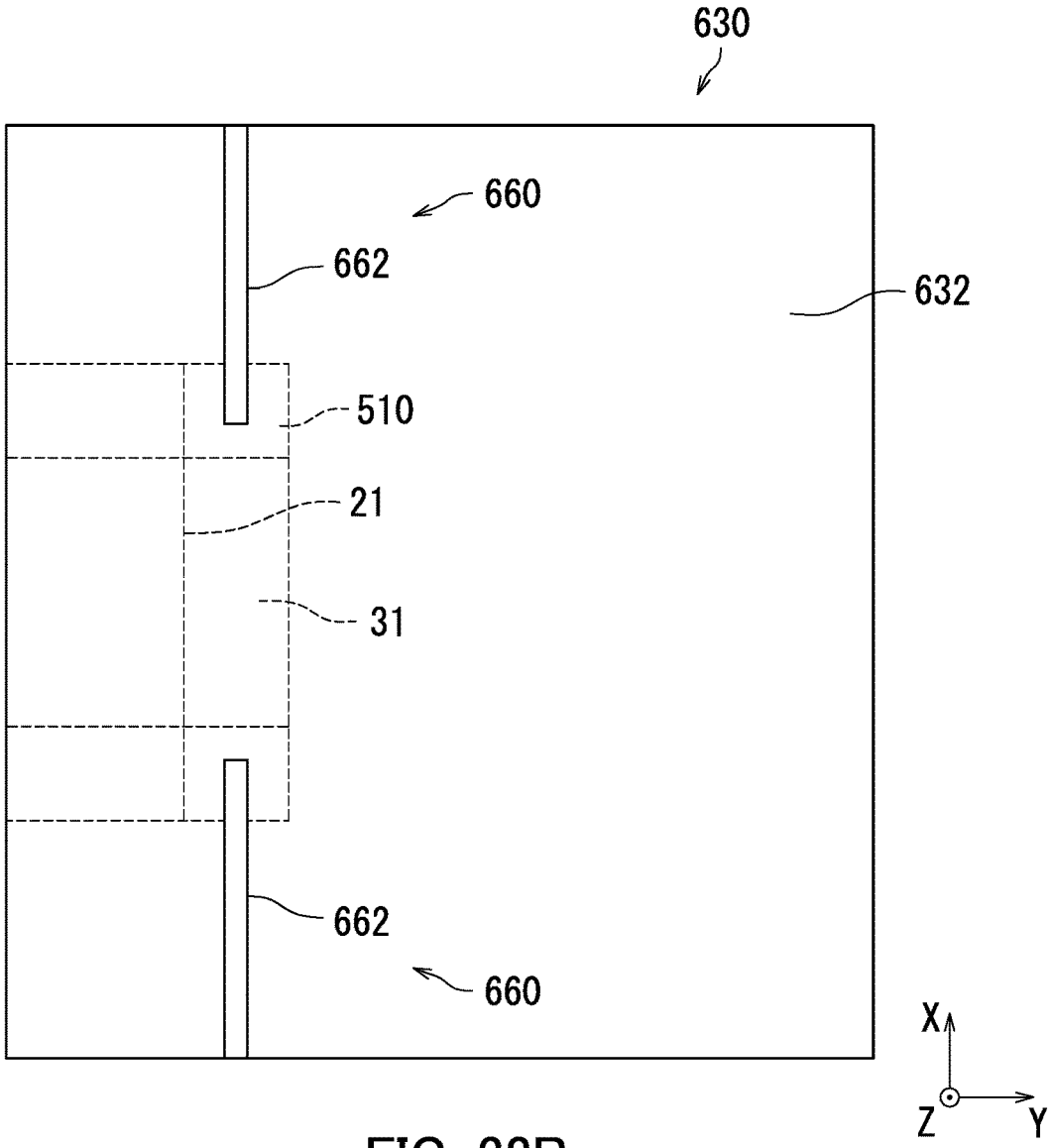
FIG. 33B is a plan view illustrating the lift restricting sections.
Figure 34A:
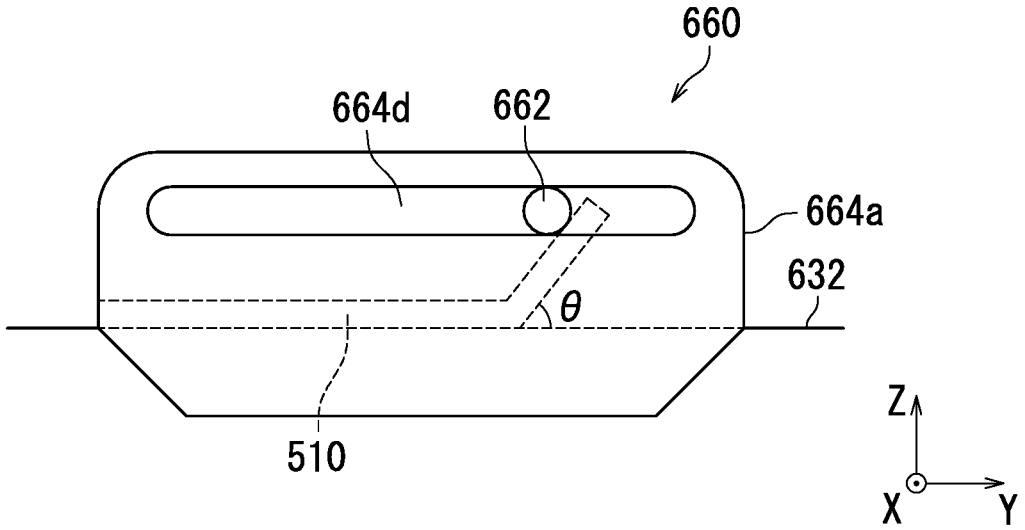
FIGS. 34A and 34B are side views each illustrating the lift restricting section.
Figure 34B:
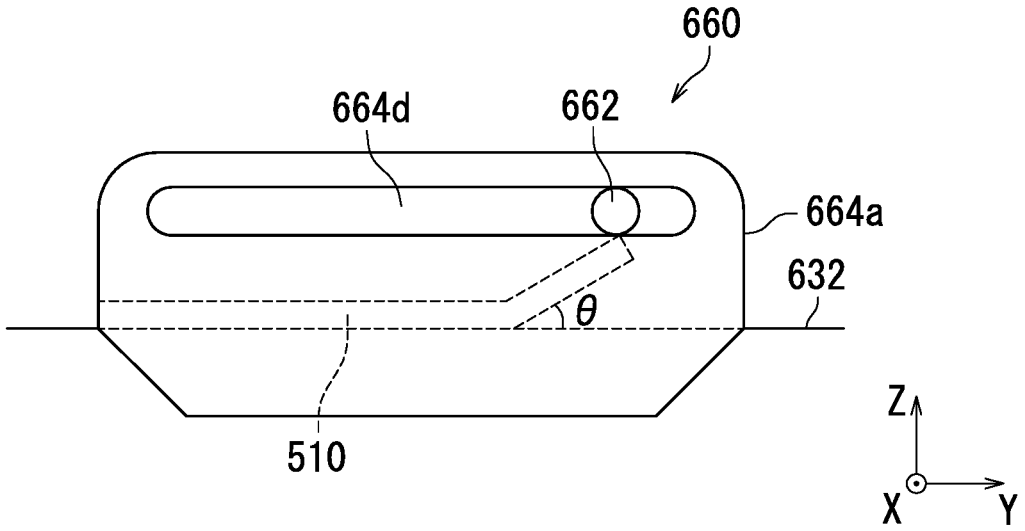

The lift restricting section 660 will be further described with reference to FIGS. 32A to 34B. FIG. 32A is a plan view illustrating the lift restricting sections 660. FIG. 32B is a side view illustrating the lift restricting section 660. FIG. 33A is a side view illustrating the lift restricting section 660. FIG. 33B is a plan view illustrating the lift restricting sections 660. FIGS. 34A and 34B are side views each illustrating the lift restricting section 660. A first fixing tool 664*b* and a second fixing tool 664*c* are omitted in FIGS. 32A, 33A, 34A, and 34B.

As illustrated in FIG. 32A, the packaging kit manufacturing apparatus 600 includes a pair of the lift restricting sections 660. Each of the lift restricting sections 660 has a contact portion 662 and a holding portion 664.

The contact portion 662 comes into contact with the plate 510 when the lower film 32 is retracted by the retracting section 650. The contact portion 662 is a rod-shaped member, for example. The contact portion 662 is made from metal, for example. The contact portion 662 has a distal end 662*a* and a proximal end 662*b*. The distal end 662*a* comes into contact with the plate 510 when the lower film 32 is retracted by the retracting section 650. A thread groove is formed in the proximal end 662*b*.

The holding portion 664 holds the contact portion 662. The holding portion 664 includes a holding plate 664*a*, the first fixing tool 664*b*, and the second fixing tool 664*c*. The holding plate 664*a* is a plate-shaped member, for example. The holding plate 664*a* is made from metal, for example. As illustrated in FIG. 32B, an opening 664*d* is formed in the holding plate 664*a*. The opening 664*d* has an elliptical shape elongate in the Y axis direction. Each of the first fixing tool 664*b* and the second fixing tool 664*c* is a nut, for example. The contact portion 662 is secured to the holding portion 664 by screwing the first fixing tool 664*b* and the second fixing tool 664*c* on the proximal end 662*b* of the contact portion 662 with the holding plate 664*a* interposed between the first and second fixing tools 664*b* and 664*c*. Through the above, the holding portion 664 holds the contact portion 662.

As illustrated in FIG. 33A, the contact portion 662 comes into contact with the plate 510 when the lower film 32 is retracted by the retracting section 650. Therefore, lift of the leading end of the plate 510 can be restricted when the lower film 32 is retracted by the retracting section 650. Further, the leading end of the plate 510 is kept angled at a specific angle θ. Therefore, the upper film 31 and the lower film 32 can be welded together by the welding section 640 in a state where the leading end of the plate 510 is angled at the angle θ.

As illustrated in FIG. 33B, when the lower film 32 is retracted by the retracting section 650, the lift restricting sections 660 each come into contact with a part of the upper surface of the plate 510 that is closer to the leading end of the plate 510 than the main fold line 21. Therefore, lift of the leading end of the plate 510 can be restricted when the lower film 32 is retracted by the retracting section 650.

Preferably, the lift restricting sections 660 each come into contact with a part of the plate 510 that is close to the leading end of the plate 510 and that does not overlap the upper film 31 when the lower film 32 is retracted by the retracting section 650, as illustrated in FIG. 33B. In the above configuration, the upper film 31 is prevented from being damaged through contact with the lift restricting sections 660 when the lower film 32 is retracted by the retracting section 650. It should be noted that the lift restricting sections 660 may each come into contact with a part of the plate 510 that is close to the leading end of the plate 510 and that overlaps the upper film 31 when the lower film 32 is retracted by the retracting section 650.

The holding portion 664 is preferably capable of changing a position to hold the contact portion 662. Specifically, the holding portion 664 is capable of changing a position to secure the contact portion 662 within the opening 664*d*. In the present embodiment, the position to secure the contact portion 662 is changeable in the Y axis direction (horizontal direction). The angle θ formed through the retraction of the lower film 32 by the retracting section 650 is changeable by changing the position to hold the contact portion 662.

For example, the contact portion 662 illustrated in FIG. 34A is secured to the opening 664*d* at a position closer to the trailing end of the plate 510 than the contact portion 662 illustrated in FIG. 34B. Therefore, the plate 510 illustrated in FIG. 34A forms a larger angle θ than the plate 510 illustrated in FIG. 34B. Thus, the angle θ is can be easily changed by changing the position to secure the contact portion 662 to the opening 664*d*.

Although the position to secure the contact portion 662 is changeable in the Y axis direction (horizontal direction) in the present embodiment, the position may be changeable in the Z axis direction (vertical direction). For example, a position to secure the holding plate 664*a* may be changeable in the Z axis direction.

As described above with reference to FIGS. 29 to 34B, the packaging kit manufacturing apparatus 600 includes the lift restricting sections 660 that restrict lift of the leading end of the plate 510. Therefore, lift of the leading end of the plate 510 can be restricted when the lower film 32 is retracted by the retracting section 650.

As described above with reference to FIGS. 29 to 34B, the contact portion 662 comes into contact with the plate 510 when the lower film 32 is retracted by the retracting section 650. Therefore, lift of the leading end of the plate 510 can be restricted when the lower film 32 is retracted by the retracting section 650. Further, the leading end of the plate 510 is kept angled at a specific angle θ. Therefore, the upper film 31 and the lower film 32 can be welded together by the welding section 640 in a state where the leading end of the plate 510 is angled at the angle θ.

As described above with reference to FIGS. 29 to 34B, the holding portion 664 is capable of changing a position to hold the contact portion 662. Therefore, the angle θ can be easily changed.

As described above with reference to FIGS. 29 to 34B, when the lower film 32 is retracted by the retracting section 650, the lift restricting sections 660 each come into contact with a part of the upper surface of the plate 510 that is closer to the leading end of the plate 510 than the main fold line 21. Therefore, lift of the leading end of the plate 510 can be restricted when the lower film 32 is retracted by the retracting section 650.

As described above with reference to FIGS. 29 to 34B, preferably, the lift restricting sections 660 each come into contact with a part of the plate 510 that is close to the leading end of the plate 510 and that does not overlap the upper film 31 when the lower film 32 is retracted by the retracting section 650. In the above configuration, the upper film 31 is prevented from being damaged through contact with the lift restricting sections when the lower film 32 is retracted by the retracting section 650.

Figure 35:
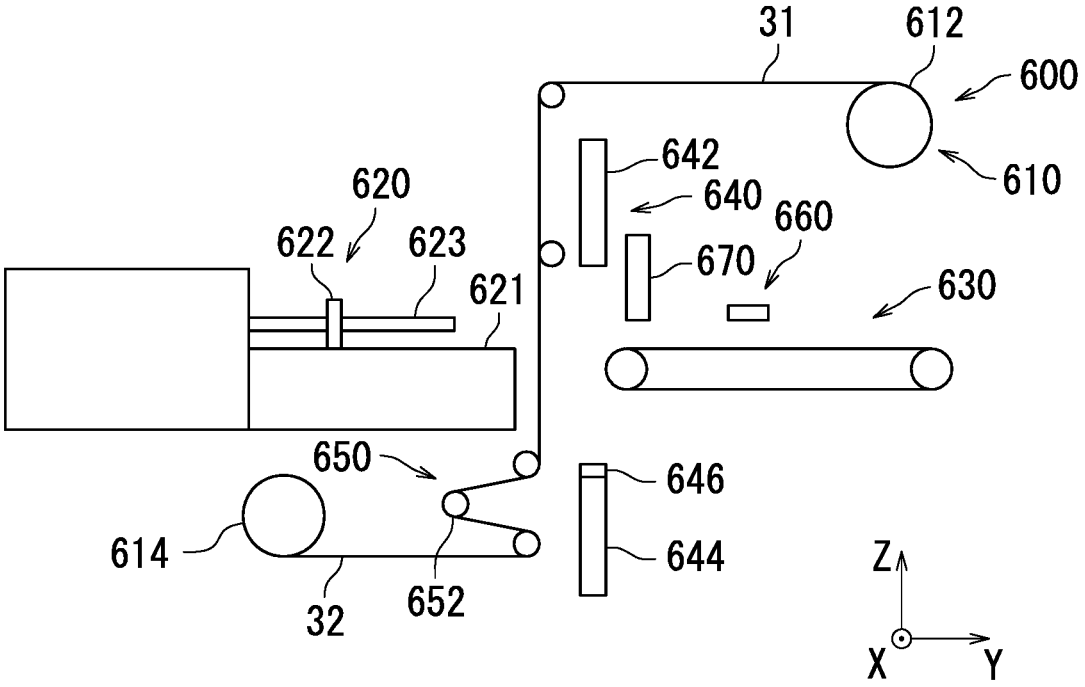
FIG. 35 is a side view schematically illustrating a packaging kit manufacturing apparatus according to an embodiment of the present invention.

A packaging kit manufacturing apparatus 600 according to an embodiment of the present invention will be described with reference to FIGS. 26 and 35. FIG. 35 is a side view schematically illustrating the packaging kit manufacturing apparatus 600 according to the embodiment of the present invention. The packaging kit manufacturing apparatus 600 illustrated in FIG. 35 has a configuration similar to that of the packaging kit manufacturing apparatus 600 illustrated in FIG. 29 except that the conveyance section 620 further includes guide sections 623 and the packaging kit manufacturing apparatus 600 further includes pressing sections 670. Description of other features similar to those described above with respect to the packaging kit manufacturing apparatus 600 illustrated in FIG. 29 will be omitted.

As illustrated in FIG. 35, the packaging kit manufacturing apparatus 600 further includes the pressing sections 670 in addition to the film feeding section 610, the conveyance section 620, the welding section 640, the retracting section 650, the lift restricting sections 660, and the discharge section 630. After the conveyance section 620 completes conveyance of the plate 510 and before the retracting section 650 retracts the lower film 32, the pressing sections 670 press the plate 510 while out of contact with the upper film 31.

The conveyance section 620 further includes the guide sections 623 in addition to the placement section 621 and the pushing section 622. The guide sections 623 restrict lift of the plate 510. The guide sections 623 guide the plate 510 such that the leading end of the plate 510 passes under the lift restricting sections 660.

Figure 36A:
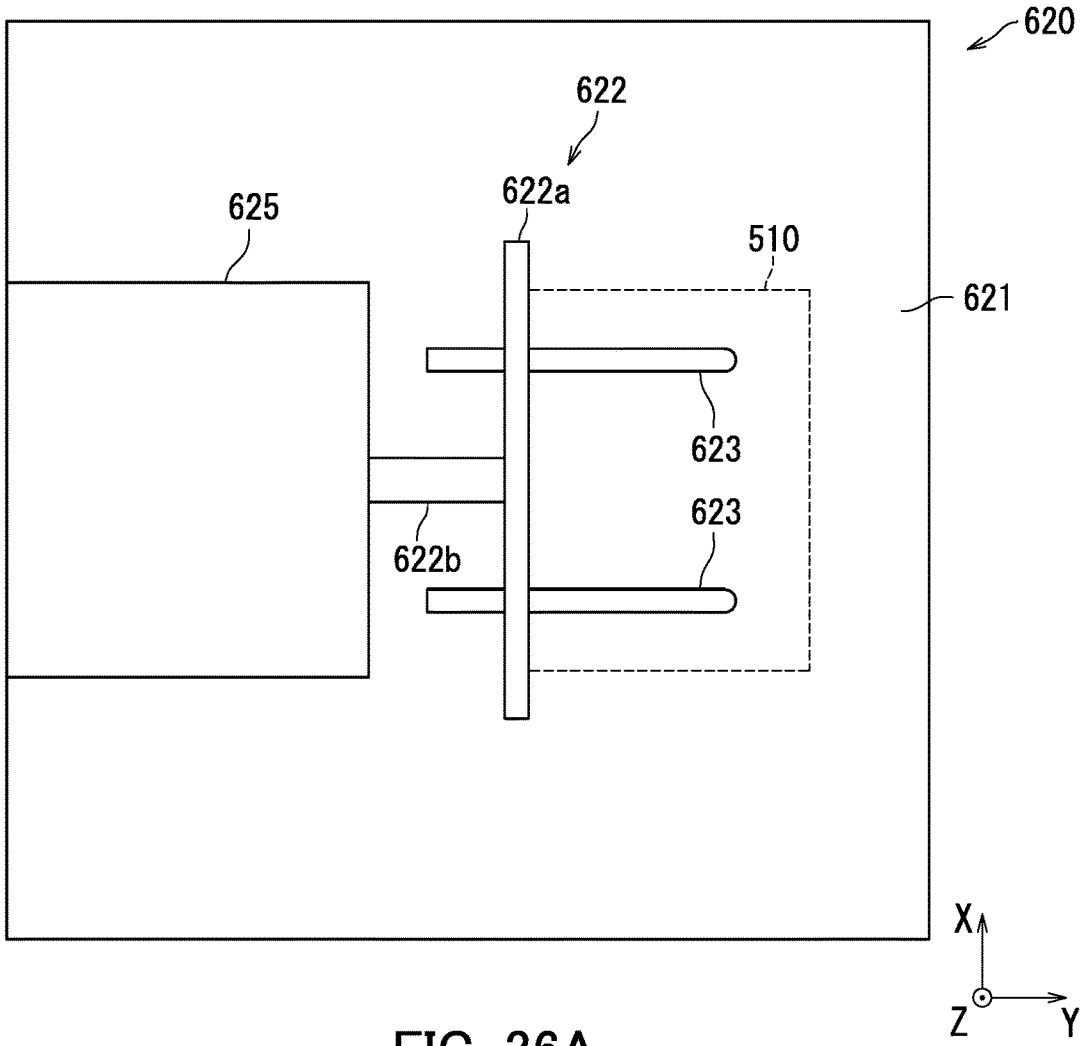
FIG. 36A is a plan view illustrating a conveyance section.
Figure 36B:
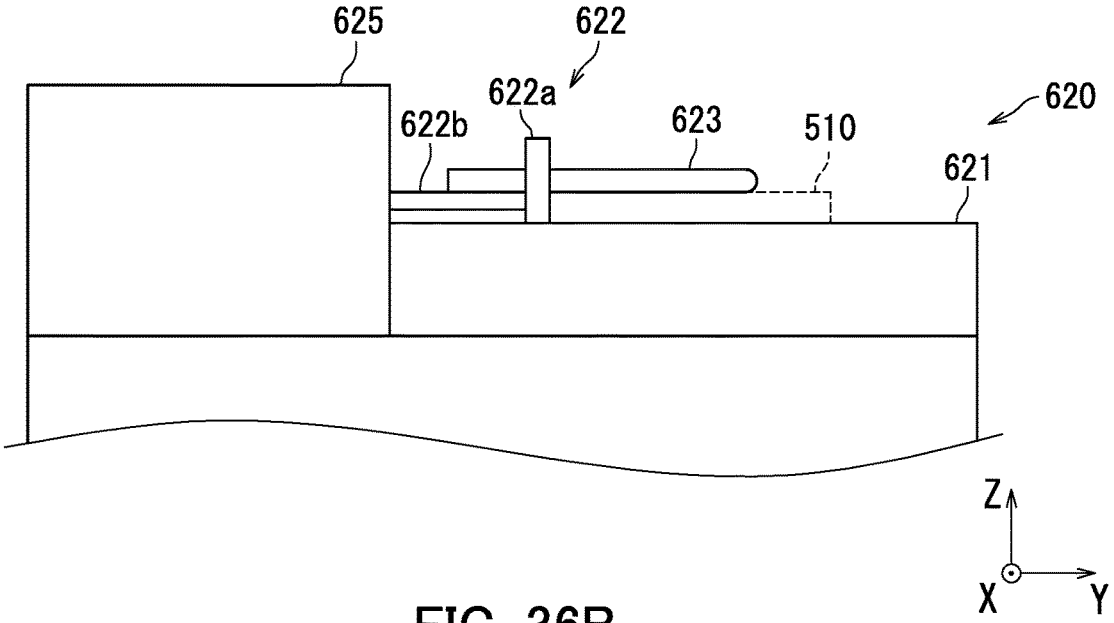
FIG. 36B is a side view illustrating the conveyance section.

The guide sections 623 will be further described with reference to FIGS. 36A and 36B. FIG. 36A is a plan view illustrating the conveyance section 620. FIG. 36B is a side view illustrating the conveyance section 620.

As illustrated in FIGS. 36A and 36B, the conveyance section 620 includes a pair of the guide sections 623 and a housing 625 in addition to the placement section 621 and the pushing section 622.

The pushing section 622 includes a pushing plate 622*a* and a pushing rod 622*b*. The pushing plate 622*a* is a plate-shaped member, for example. The pushing rod 622*b* is a rod-shaped member, for example. The pushing plate 622*a* is attached to an end of the pushing rod 622*b*. The other end of the pushing rod 622*b* is attached to a cylinder provided in the housing 625. The cylinder causes the position of the distal end of the pushing rod 622*b* to move in the Y axis direction. That is, the position of the pushing plate 622*a* moves in the Y axis direction. As a result, the pushing plate 622*a* pushes the trailing end of the plate 510 to convey the plate 510 in the horizontal direction.

Each of the guide sections 623 is a rod-shaped member. The guide sections 623 are made from metal, for example. The guide sections 623 restrict lift of the plate 510 over the length from the trailing end to the leading end thereof at respective opposite ends of the plate 510 in the X axis direction. Through the above, the guide sections 623 guide the plate 510 such that the leading end of the plate 510 passes under the lift restricting sections 660.

Figure 37A:
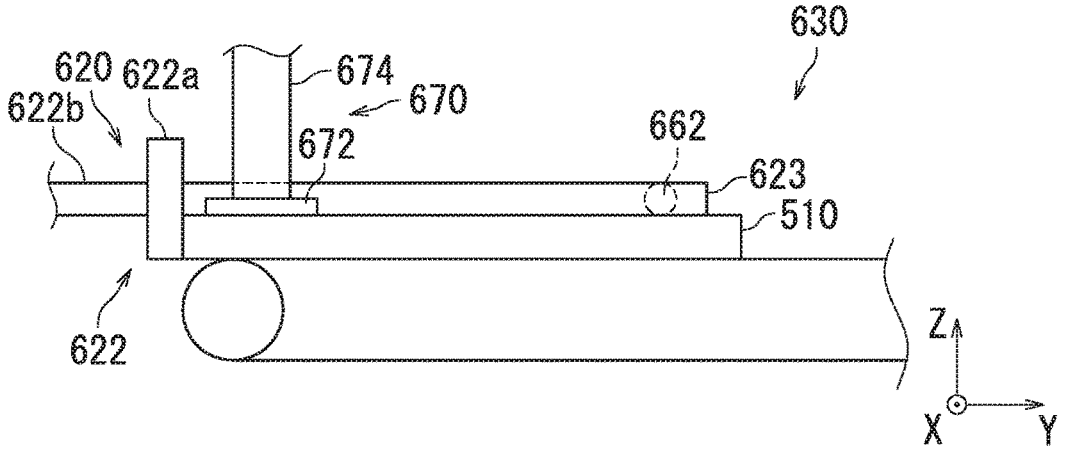
FIG. 37A is a side view illustrating a vicinity of one of pressing sections.
Figure 37B:
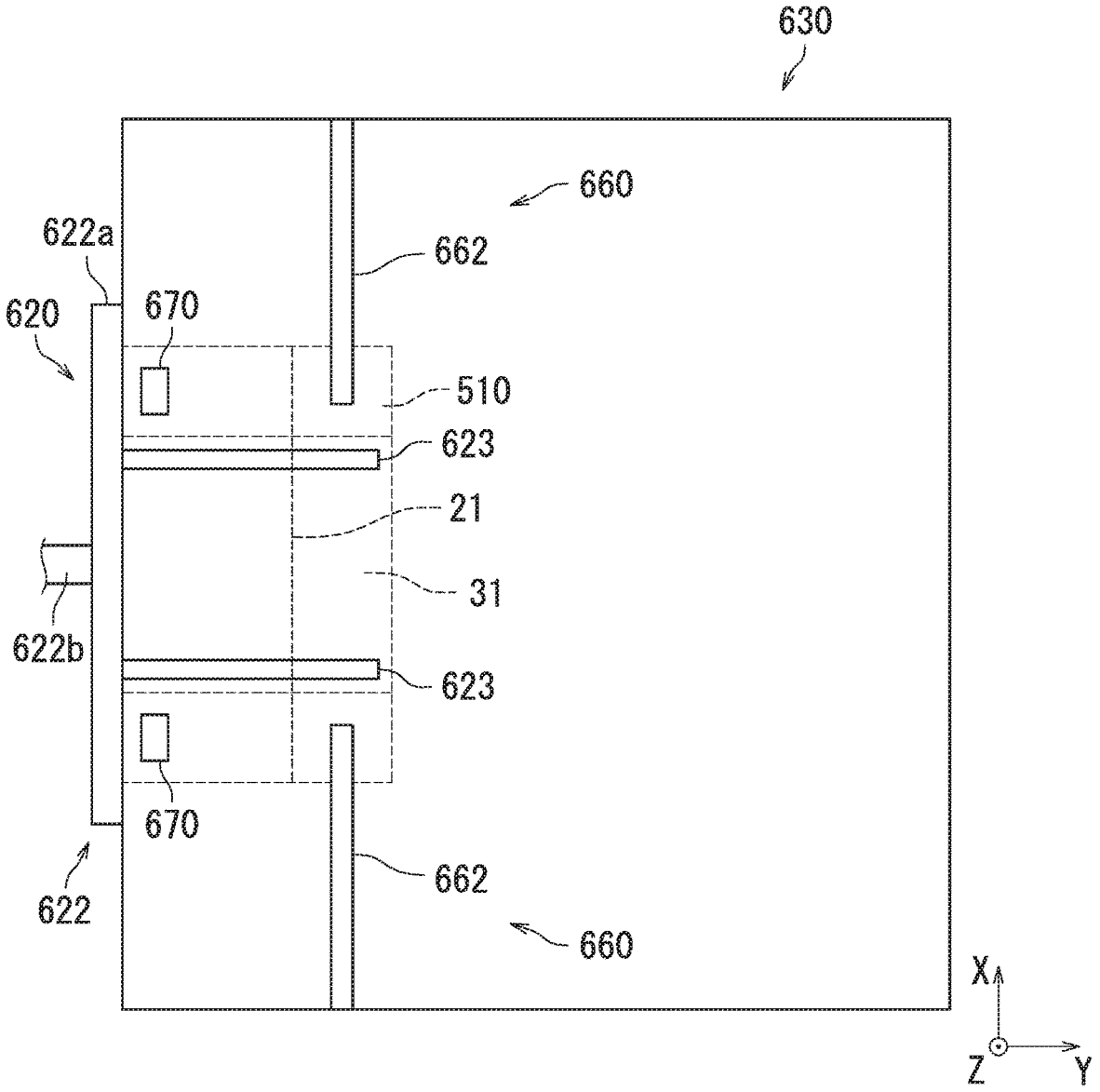
FIG. 37B is a plan view illustrating a vicinity of the pressing sections.

The pressing sections 670 will be further described with reference to FIGS. 37A and 37B. FIG. 37A is a side view illustrating a vicinity of one of the pressing sections 670. FIG. 37B is a plan view illustrating a vicinity of the pressing sections 670.

As illustrated in FIG. 37A, each of the pressing sections 670 has a pressing plate 672 and a pressing rod 674. The pressing plate 672 is a plate-shaped member, for example. The pressing rod 674 is a rod-shaped member, for example. The pressing plate 672 is attached to one of ends of the pressing rod 674. The other end of the pressing rod 674 is attached to a cylinder. The cylinder causes the position of the distal end of the pressing rod 674 to move in the Z axis direction. That is, the position of the pressing plate 672 moves in the Z axis direction. As a result, the pressing plate 672 presses the upper surface of the plate 510 to restrict movement of the plate 510.

After the conveyance section 620 completes conveyance of the plate 510 and before the retracting section 650 retracts the lower film 32, the pressing sections 670 press the plate 510 while out of contact with the upper film 31, as illustrated in FIG. 37B. Therefore, the upper film 31 is prevented from being damaged through contact with the pressing sections 670.

Further, as illustrated in FIG. 37B, the guide sections 623 are arranged at positions not interfering with the lift restricting sections 660 when the conveyance section 620 completes conveyance of the plate 510. Therefore, collision of the guide sections 623 with the lift restricting sections 660 can be prevented.

Figure 38:
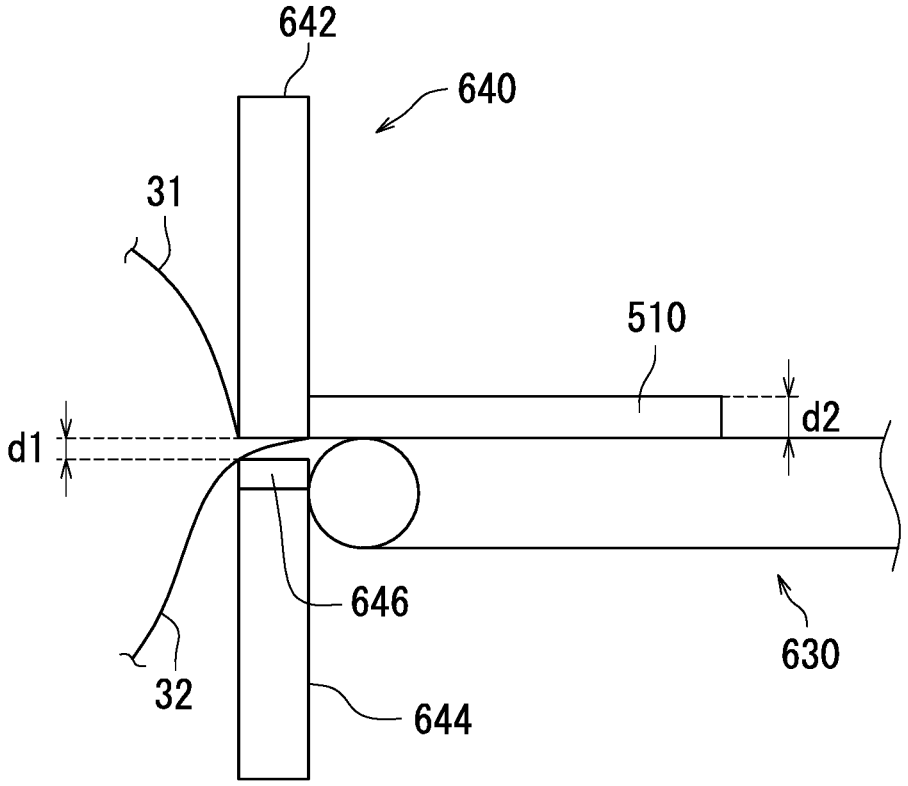
FIG. 38 is a side view illustrating a vicinity of a welding section.

Preferably, a gap is formed between the sealing section 644 and the sealing section receiving section 642 when the lower film 32 is retracted by the retracting section 650. FIG. 38 is a side view illustrating a vicinity of the welding section 640. FIG. 38 illustrates a gap d1 between the sealing section 644 and the sealing section receiving section 642 at the time of retraction of the lower film 32 by the retracting section 650. The thickness of the plate 510 is indicated by d2.

As illustrated in FIG. 38, when the lower film 32 is retracted by the retracting section 650, the gap d1 is larger than the thicknesses of the films (the upper film 31 and the lower film 32) and smaller than the thickness d2 of the plate 510. Therefore, when the lower film 32 is retracted by the retracting section 650, only the films pass through the gap d1 and the plate 510 does not pass through the gap d1. As a result, the lower film 32 can be retracted while the plate 510 is prevented from moving into the gap d1 between the sealing section 644 and the sealing section receiving section 642.

As described above with reference to FIGS. 35 to 38, the conveyance section 620 further includes the guide sections 623 in addition to the placement section 621 and the pushing section 622. Therefore, lift of the plate 510 is restricted by the guide sections 623 and the plate 510 is guided by the guide sections 623 such that the leading end of the plate 510 passes under the lift restricting sections 660.

As described above with reference to FIGS. 35 to 38, the guide sections 623 are arranged at respective positions not interfering with the lift restricting sections 660 when the conveyance section 620 completes conveyance of the plate 510. Therefore, collision of the guide sections 623 with the lift restricting sections 660 is prevented.

As described above with reference to FIGS. 35 to 38, the packaging kit manufacturing apparatus 600 includes the pressing sections 670. Therefore, after the conveyance section 620 completes conveyance of the plate 510, movement of the plate 510 can be restricted by the pressing section 670 pressing the upper surface of the plate 510.

As described above with reference to FIGS. 35 to 38, when the lower film 32 is retracted by the retracting section 650, the gap d1 between the sealing section 644 and the sealing section receiving section 642 is larger than the thicknesses of the films (the upper film 31 and the lower film 32) and smaller than the thickness d2 of the plate 510. Therefore, when the lower film 32 is retracted by the retracting section 650, only the films pass through the gap d1 and the plate 510 does not pass through the gap d1. As a result, the lower film 32 can be retracted while the plate 510 is prevented from moving into the gap d1 between the sealing section 644 and the sealing section receiving section 642.

Figure 39A:
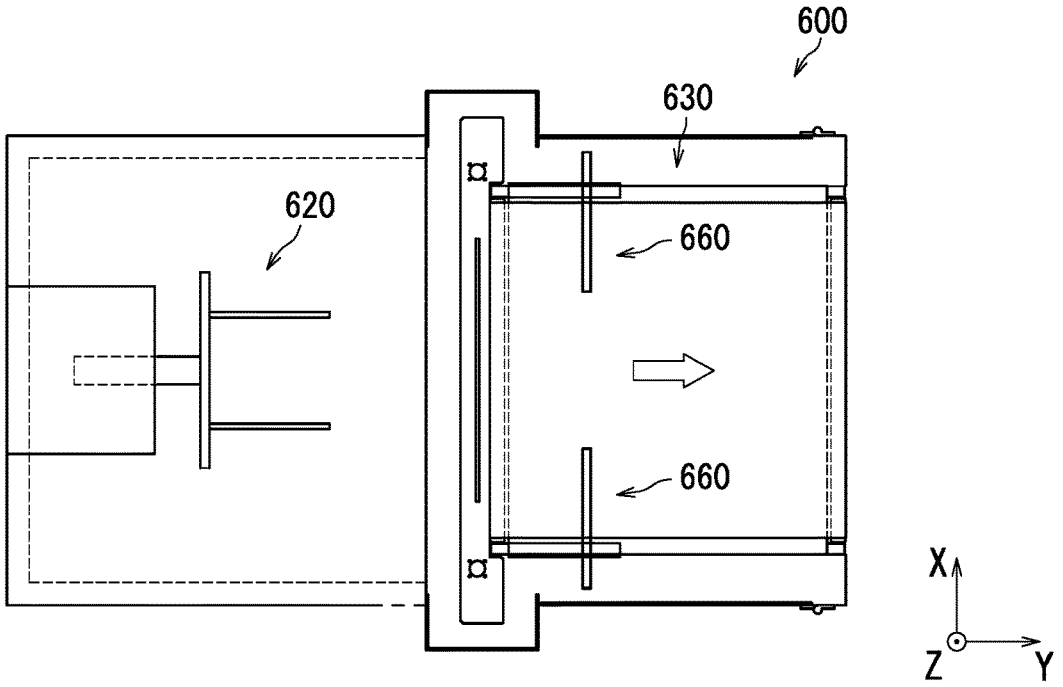
FIG. 39A is a plan view of a packaging kit manufacturing apparatus 600 according to an embodiment of the present invention.
Figure 39B:
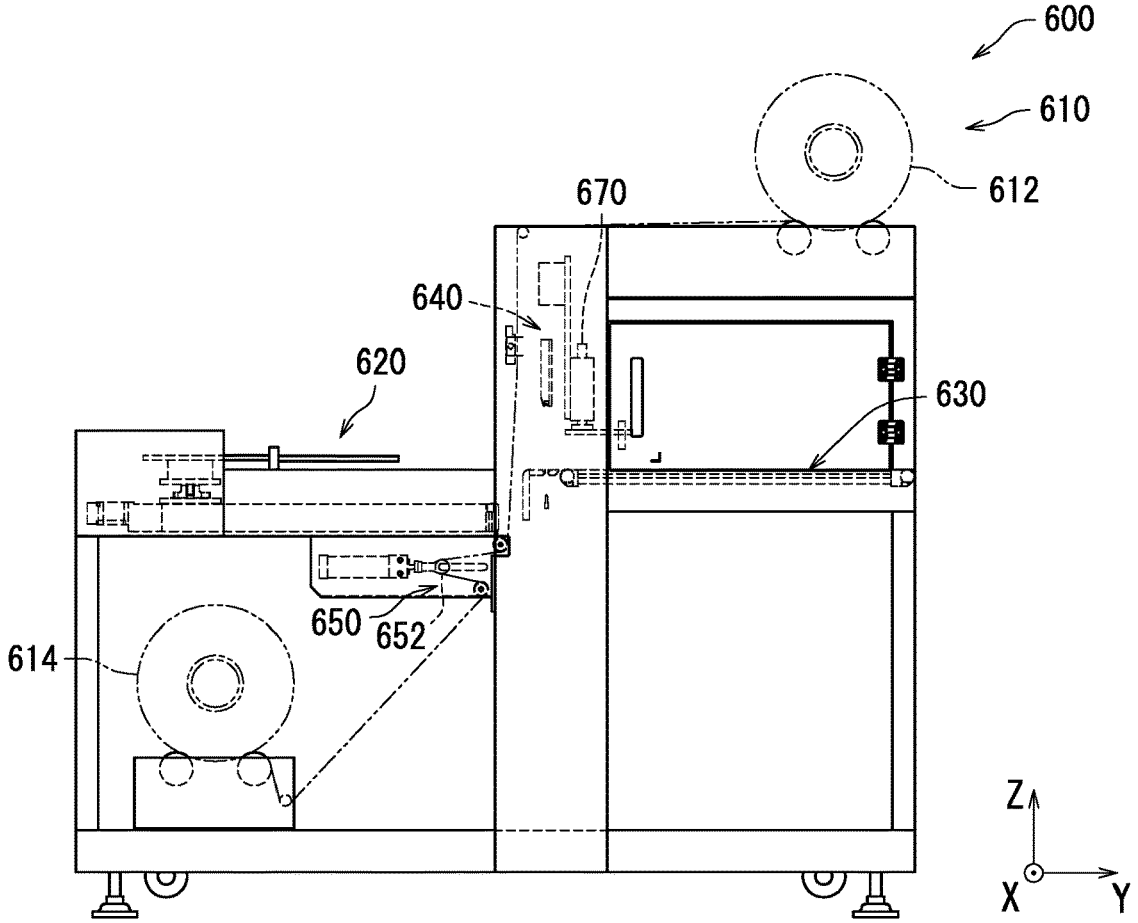
FIG. 39B is a side view of the packaging kit manufacturing apparatus 600 according to the embodiment of the present invention.

A packaging kit manufacturing apparatus 600 according to an embodiment of the present invention will be further described with reference to FIGS. 39A and 39B. FIG. 39A is a plan view illustrating the packaging kit manufacturing apparatus 600 according to the embodiment of the present invention. FIG. 39B is a side view illustrating the packaging kit manufacturing apparatus 600 according to the embodiment of the present invention. As illustrated in FIGS. 39A and 39B, the packaging kit manufacturing apparatus 600 includes the film feeding section 610, the conveyance section 620, the welding section 640, the retracting section 650, the lift restricting sections 660, the pressing sections 670, and the discharge section 630.

Through the above, the embodiments of the present invention have been described with reference to the drawings (FIGS. 1A to 39B). However, the present invention is not limited to the above embodiments and is practicable in various manners within the scope not departing from the gist of the present invention (for example, as described below in sections (1) to (9)). The drawings schematically illustrate elements of configuration in order to facilitate understanding, and properties of elements of configuration illustrated in the drawings, such as thicknesses, lengths, and numbers thereof, may differ from actual properties thereof in order to facilitate preparation of the drawings. Furthermore, properties of the elements of configuration described in the above embodiment, such as materials, shapes and dimensions, are merely examples and are not intended as specific limitations. Various alterations may be made so long as there is no substantial deviation from the effects of the present invention.

(1) Materials of the plate and the film are not limited to those in the above embodiments. Other than the corrugated board, a cardboard or the like may be used as the plate. Also, the plate need not be made from paper and may be made from resin such as polyethylene or rubber. In a configuration in which the plate is made from rubber, tension can be applied to the film by elasticity of the plate when the plate is brought into an unfolded state. It is only required that the plate is a plate-shaped member that can be folded and then unfolded again. The film need not be made from polyethylene and may be made from rubber. Also, the film need not be made from resin such as polyethylene or rubber and may be made from fiber such as cloth or paper. The film may be stretchable or unstretchable. A stretchable film is preferred in order to apply tension to the film when the plate is unfolded. A plurality of tubular films may be attached to a single plate in combination.

(2) Dimensions of the plate and the circumferential length of the film can be changed appropriately according to an article to be packaged. The plate need not be rectangular and may be triangular or five- or more-sided polygonal. The circumferential length of the film can be determined as appropriate so that an article can be placed when the plate is folded and tension can be applied to the film when the plate is thereafter unfolded. The film need not be in the form of a band and may be in the form of a net. Also, the film need not be flat and may have raised parts and recessed parts like a bubble wrap.

(3) The present invention is, but is not limited to, the configuration in which the plate is constituted by the front liner 19*a*, the back liner 19*b*, and the core sheet 19*c*. The plate may be constituted by a single plate-shaped member without a core sheet.

(4) A tubular film-shaped member may be used in place of the stretchable film. A plurality of films may be arranged in a direction of extension of the main fold line.

(5) The outer casing is not limited to that made from a corrugated board as described above. Various outer casings is adaptable.

(6) A package may be configured by for example securing a thin article on the plate of the packaging kit of any of the above-described embodiments, putting the article secured on the plate into an outer bag such as an envelope, and sealing the outer bag. Other than the above, various articles can be packaged in various manners using the packaging kit.

(7) The packaging kit is not limited to that manufactured using the packaging kit manufacturing apparatus 600. The packaging kit may be manufactured by for example inserting the plate inside a film that has been formed into an annular shape beforehand and attaching the film to the plate.

(8) The present invention is not limited to a configuration in which the lower film 32 is retracted by moving the retraction roller 652 of the packaging kit manufacturing apparatus 600 in the Y axis direction. It is possible to wind up the lower film 32 rather than moving the retraction roller 652.

(9) The present invention is not limited to a configuration in which the sealing section 644 of the packaging kit manufacturing apparatus 600 is located below the sealing section receiving section 642. The sealing section 644 may be located above the sealing section receiving section 642.

REFERENCE SIGNS LIST

1, 201, 301, 501 Packaging kit
10, 210, 310, 410, 510 Plate (an example of a plate-shaped member)
11, 211, 411, 511 Placement surface portion
12, 212, 213, 412, 413, 512 Adjacent surface portion
15, 16, 315, 316 Stand-up portion
19*c* Core sheet
21, 221, 222, 421, 422 Main fold line
23, 24 Sub-fold line
23*b*, 24*b* Auxiliary fold line
30, 530 Film (tubular film)
31 Upper film
32 Lower film
50 Article
70 Outer casing
80, 380 Package
90, 290 Jig
600 Packaging kit manufacturing apparatus
610 Film feeding section
620 Conveyance section
621 Placement section
622 Pushing section
623 Guide section
640 Welding section
642 Sealing section receiving section
644 Sealing section
646 Heat source
650 Retracting section
660 Lift restricting section
662 Contact portion
664 Holding portion
670 Pressing section

The invention claimed is:

1. A packaging kit manufacturing apparatus that manufactures a packaging kit including a plate-shaped member having an upper surface with a fold line thereon and a tubular film lapped around the plate-shaped member, the packaging kit manufacturing apparatus comprising:

a film feeding section including a conveyance roller, and configured to feed a film through rotation of the conveyance roller;

a conveyance section including a pushing rod and a pushing plate, and configured to convey a plate-shaped member having an upper surface with a fold line thereon such that a leading end of the plate-shaped member pushes the film through the pushing plate moving along the pushing rod, the pushing plate being in a plate shape, the pushing plate being attached to the pushing rod;

a welding section including a blade, and configured to weld the film to form the tubular film by bringing the blade into contact with the film;

a retracting section including a retraction roller, and configured to retract the film to fold the plate-shaped member along the fold line before the welding section welds the film through movement of the retracting roller; and a lift restricting section including a restricting bar, and configured to restrict lift of the leading end of the plate-shaped member through the restricting bar coming into contact with the plate-shaped member when the film is retracted by the retracting section.

2. The packaging kit manufacturing apparatus according to claim 1, wherein the lift restricting section includes:

a contact portion that comes into contact with the plate-shaped member when the film is retracted by the retracting section; and a holding portion that holds the contact portion, the holding portion being capable of changing a position to hold the contact portion.

3. The packaging kit manufacturing apparatus according to claim 1, wherein when the film is retracted by the retracting section, the lift restricting section comes into contact with a part of the upper surface of the plate-shaped member that is closer to the leading end of the plate-shaped member than the fold line.

4. The packaging kit manufacturing apparatus according to claim 1, wherein when the film is retracted by the retracting section, the film is lapped around a part of the plate-shaped member and the lift restricting section comes into contact with a part of the plate-shaped member that is close to the leading end of the plate-shaped member and that does not overlap the film.

5. The packaging kit manufacturing apparatus according to claim 1, wherein the conveyance section includes:

a placement section on which the plate-shaped member is placed;

a pushing section that pushes a trailing end of the plate-shaped member placed on the placement section to convey the plate-shaped member in a horizontal direction; and a guide section that guides the plate-shaped member while restricting lift of the plate-shaped member such that the leading end of the plate-shaped member passes under the lift restricting section.

6. The packaging kit manufacturing apparatus according to claim 5, wherein the guide section is arranged at a position not interfering with the lift restricting section when the conveyance section completes conveyance of the plate-shaped member.

7. The packaging kit manufacturing apparatus according to claim 1, further comprising a pressing section configured to press the plate-shaped member while out of contact with the film after the conveyance section completes conveyance of the plate-shaped member.

8. The packaging kit manufacturing apparatus according to claim 1, wherein the welding section includes:

a sealing section including a heat source; and a sealing section receiving section that receives the sealing section, the welding section welds the film by bringing the sealing section and the sealing section receiving section into contact with each other, and when the film is retracted by the retracting section, a gap between the sealing section and the sealing section receiving section is larger than a thickness of the film and smaller than a thickness of the plate-shaped member.

9. A packaging kit manufacturing method for manufacturing a packaging kit including a plate-shaped member having an upper surface with a fold line thereon and a tubular film lapped around the plate-shaped member, the packaging kit manufacturing method comprising:

preparing a film, a plate-shaped member having an upper surface with a fold line thereon, and a packaging kit manufacturing apparatus including a lift restricting section and a welding section, the lift restricting section including a restricting bar;

lapping the film around the plate-shaped member in a manner that the film comes into contact with the plate-shaped member from a leading end to a trailing end thereof by pushing the film with the leading end of the plate-shaped member;

retracting the film to fold the plate-shaped member along the fold line until lift of the leading end of the plate-shaped member is restricted by the leading end of the plate-shaped member coming into contact with the restricting rod of the lift restricting section; and forming the tubular film by welding the film by the welding section.

10. A packaging kit used for packaging an article, the packaging kit comprising:

a plate-shaped member; and a tubular film lapped around the plate-shaped member, wherein the plate-shaped member comprises:

a single fold line displaced from a center of the plate-shaped member, a single placement surface portion on which the article to be packaged is to be placed; and a single adjacent surface portion adjacent to the placement surface portion, the placement surface portion and the adjacent surface portion being separated by the fold line, the tubular film is lapped around the plate-shaped member such that the fold line between the placement surface portion and the adjacent surface portion extends along a longitudinal axis of a tube that the tubular film forms, and the plate-shaped member is in a state of being partially folded along the fold line, the article is to be placed completely over the placement surface in a space between the placement surface portion and the tubular film in a state where the adjacent surface portion is folded relative to the placement surface portion, and the article is secured by tightening the tubular film while in contact with the article in accompaniment with unfolding of the adjacent surface portion relative to the placement surface portion so the article is pressed between the tubular film and the plate-shaped member.

11. The packaging kit according to claim 10, wherein the plate-shaped member is made from a corrugated board, and the fold line of the plate-shaped member is formed to traverse waves of a core sheet of the plate-shaped member.

12. The packaging kit according to claim 10, wherein the placement surface portion of the plate-shaped member has an area larger than that of the adjacent surface portion.

13. The packaging kit according to claim 10, wherein the tubular film is a stretchable film.

14. The packaging kit according to claim 10, wherein the plate-shaped member is partitioned by a sub-fold line that intersects with the fold line between the placement surface portion and the adjacent surface portion on the plate-shaped member, and has a stand-up portion adjacent to the placement surface portion with the sub-fold line therebetween, and by folding the stand-up portion relative to the placement surface portion along the sub-fold line, the adjacent surface portion is unfolded relative to the placement surface portion and the tubular film is kept tightened.

15. The packaging kit according to claim 14, wherein the sub-fold line is perforated, and the fold line is not perforated.

16. The packaging kit according to claim 14, wherein the plate-shaped member has two stand-up portions including the stand-up portion and an additional stand-up portion, the two stand-up portions each being defined by a corresponding one of two sub-fold lines including the sub-fold line and an additional sub-fold line that does not intersect with the sub-fold line on the plate-shaped member.

17. The packaging kit according to claim 14, wherein the stand-up portion is partitioned by an auxiliary fold line substantially parallel with the sub-fold line, and has portions defined by the auxiliary fold line therebetween, one of the portions being capable of being folded relative to the other of the portions.

18. A package comprising the packaging kit according to claim 14 and an outer casing that accommodates the packaging kit therein, wherein the stand-up portion of the plate-shaped member is kept folded relative to the placement surface portion when the packaging kit is accommodated in the outer casing in a state where the stand-up portion is folded relative to the placement surface portion.

19. The package according to claim 18, wherein in a state where the packaging kit is accommodated in the outer casing, a bottom part of the packaging kit and an upper part of the stand-up portion are held in contact with or close to an inner surface of the outer casing.

* * * * *